US009996099B2

(12) United States Patent
Kimura

(10) Patent No.: US 9,996,099 B2
(45) Date of Patent: Jun. 12, 2018

(54) BIAS GENERATOR CIRCUIT, VOLTAGE GENERATOR CIRCUIT, COMMUNICATIONS DEVICE, AND RADAR DEVICE

(71) Applicant: SOCIONEXT INC., Kanagawa (JP)

(72) Inventor: Hiroshi Kimura, Suita (JP)

(73) Assignee: Socionext, Inc., Kanagawa (JP)

( * ) Notice: Subject to any disclaimer, the term of this patent is extended or adjusted under 35 U.S.C. 154(b) by 0 days. days.

(21) Appl. No.: 15/443,284

(22) Filed: Feb. 27, 2017

(65) Prior Publication Data

US 2017/0192447 A1 Jul. 6, 2017

Related U.S. Application Data

(63) Continuation of application No. PCT/JP2015/003627, filed on Jul. 17, 2015.

(30) Foreign Application Priority Data

Aug. 28, 2014 (JP) ..... 2014-173522

(51) Int. Cl.
*G05F 3/08* (2006.01)
*G05F 3/16* (2006.01)
*G05F 1/648* (2006.01)

(52) U.S. Cl.
CPC ..... *G05F 3/16* (2013.01)

(58) Field of Classification Search
CPC ..... G05F 3/02; G05F 3/08; G05F 3/16; G05F 3/205; G05F 1/648; G05F 3/10
See application file for complete search history.

(56) References Cited

U.S. PATENT DOCUMENTS 7,999,628 B2 8/2011 Miyashita
2010/0237956 A1 9/2010 Miyashita
2011/0204866 A1* 8/2011 Moon ..... H02M 1/36 323/284

FOREIGN PATENT DOCUMENTS

JP 05-011872 A 1/1993
JP H09-325822 A 12/1997
JP 2008-300766 A 12/2008
JP 2010-219964 A 9/2010

OTHER PUBLICATIONS

Written Opinion and International Search Report dated Oct. 6, 2015 issued in International Patent Application No. PCT/JP2015/003627 (partial English translation).

* cited by examiner

*Primary Examiner* — Gary L Laxton
(74) *Attorney, Agent, or Firm* — McDermott Will & Emery LLP

(57) ABSTRACT

Disclosed herein is a bias generator circuit for generating a desired bias voltage or bias current using a simple configuration. The bias generator circuit includes a voltage generator circuit, a comparator, and a clock gating circuit. The voltage generator circuit increases or decreases its output voltage in accordance with the number of clock cycles of a given clock signal. The comparator compares the output voltage of the voltage generator circuit to a reference voltage. The clock gating circuit receives, as a control signal, output of the comparator and determines, in accordance with the control signal, whether or not to pass the clock signal to the voltage generator circuit. Thus, the output voltage of the voltage generator circuit, i.e., a bias voltage, is set to be close to the reference voltage.

31 Claims, 11 Drawing Sheets

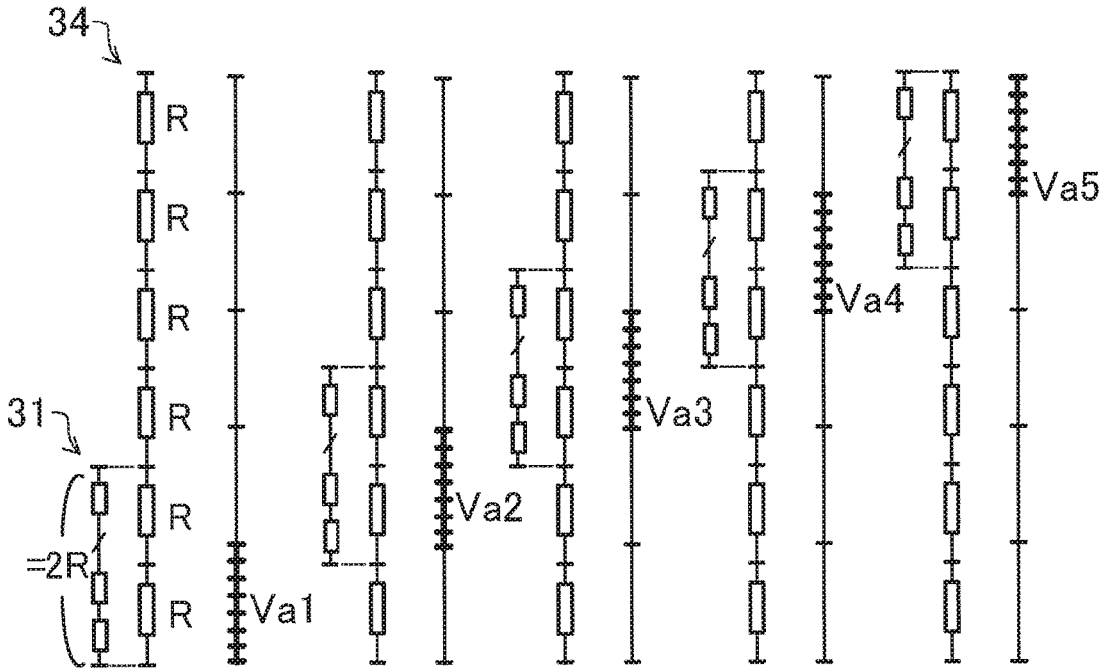
FIG. 5A FIRST RESISTOR BANK = 2R
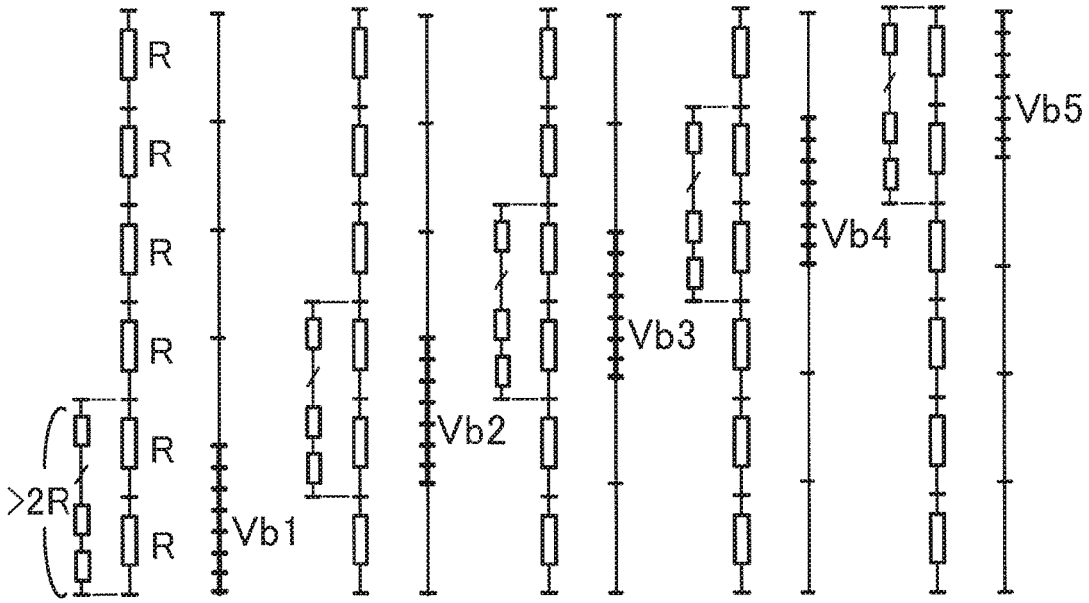
FIG. 5B FIRST RESISTOR BANK > 2R

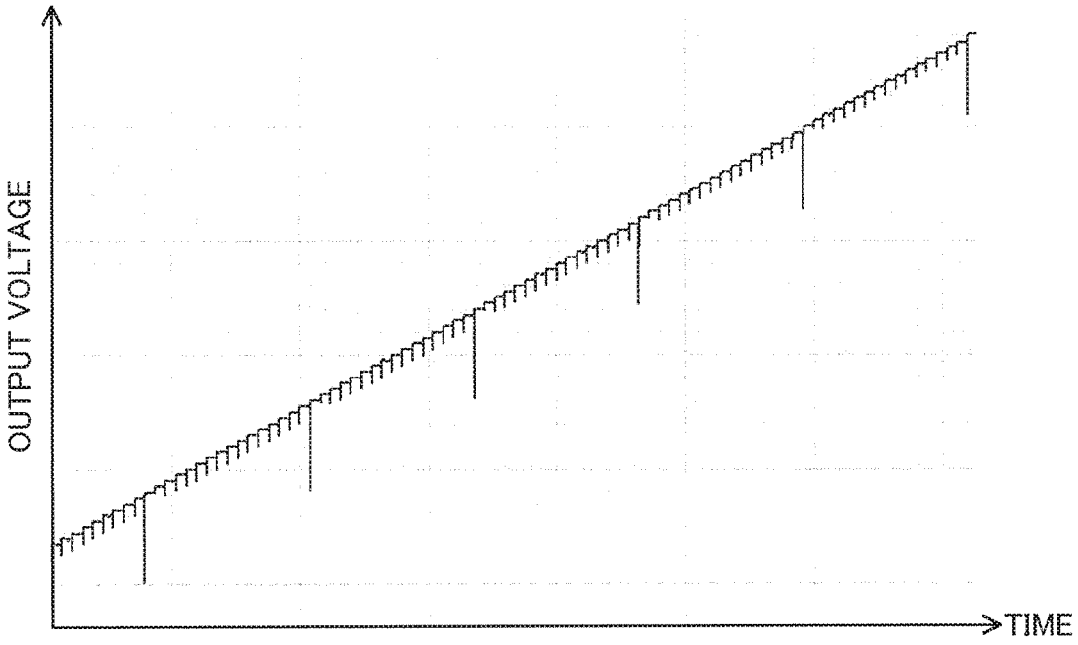
FIG. 6A FIRST RESISTOR BANK = 2R
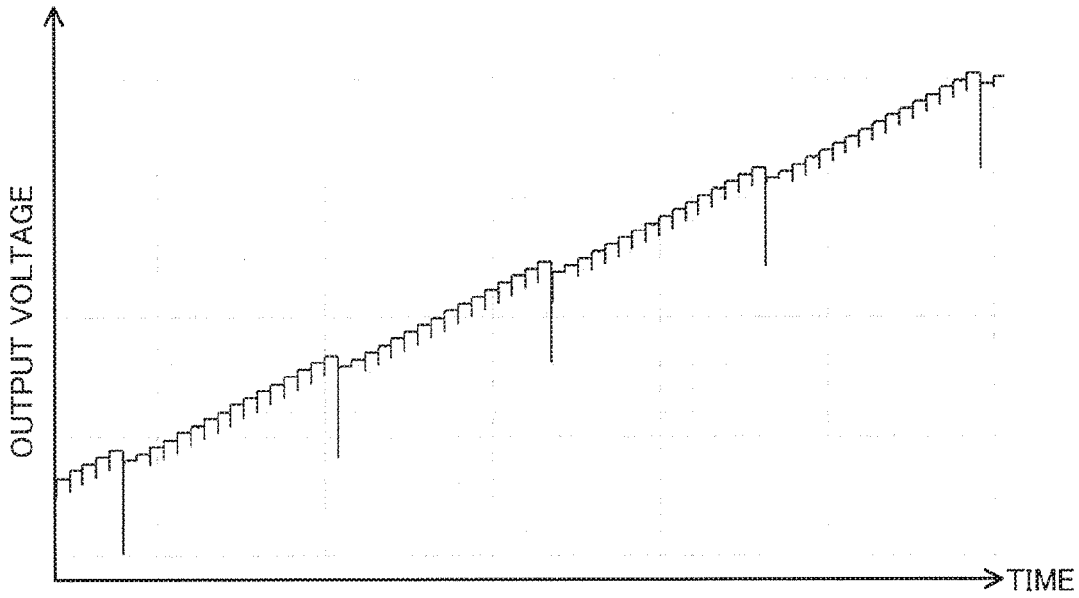
FIG. 6B FIRST RESISTOR BANK > 2R

4C
VOLTAGE GENERATOR CIRCUIT

CLOCK GENERATOR
CLOCK SIGNAL
REFERENCE VOLTAGE Vref
BIAS VOLTAGE Vbias
RESET SIGNAL
Reset
CLKin
Vout
VSS
Vdd
Rd
Rs
VH
VL
FF50
FF40
FF30
FF20
FF10
RET
SET
Rc1
Rc2
Rc3
Rc4
Rc5
Rc6
Rc7
Rc8
R1
R2
R3
R4
R5
R6
R7
R8
VR1
VR2
VR3
VR4
VR5
VR6
VR7
VR8
FF1
FF2
FF3
FF4
FF5
FF6
FF7
FF8
SW11
SW12
SW13
SW14
SW15
SW16
SW17
SW18
SW19
SW20
1
2
3
14
15
16
31
32
33
41
42
43
44
45

BIAS GENERATOR CIRCUIT, VOLTAGE GENERATOR CIRCUIT, COMMUNICATIONS DEVICE, AND RADAR DEVICE

CROSS-REFERENCE TO RELATED APPLICATION

This is a continuation of International Application No. PCT/JP2015/003627 filed on Jul. 17, 2015, which claims priority to Japanese Patent Application No. 2014-173522 filed on Aug. 28, 2014. The entire disclosures of these applications are hereby incorporated by reference.

BACKGROUND

The present disclosure relates to a technique for generating a low-noise bias voltage and a low-noise bias current.

A transceiver circuit for use in wireless communications devices, for example, is required to exhibit strict low-noise characteristics to achieve excellent sensitivity performance. A circuit comprised of CMOS transistors, however, often generates a so-called "flicker noise," which constitutes a major obstacle to reducing the noise to a desired low level. The flicker noise is inevitably generated in such a structure where a current flows through an interface between silicon and an oxide film, because carriers are randomly trapped by, or released from, lattice defects existing on the interface. The flicker noise is generated in any of various types of circuits including transistors as their components. Among other things, a significant flicker noise generated in a bias circuit, functioning as a basic element of an analog circuit, would affect every circuit supplied with a bias voltage or a bias current by the bias circuit. Thus, it is meaningful to reduce the noise of a bias circuit to a sufficiently low level.

Meanwhile, the flicker noise could be reduced by the use of transistors of an increased size. Nevertheless, an increase in the size of transistors leads to an increase in the overall chip area. In other words, use of transistors of an increased size causes an increase in costs. Also, in a current mirror circuit, for example, transistors on the input end often constitute a source of a non-negligible flicker noise. However, an increase in the size of those transistors would prevent the current mirror circuit from having a high mirror ratio and would require an increased amount of drain current to supply a predetermined amount of current to transistors on the output end, thus resulting in a considerable increase in power consumption.

U.S. Pat. No. 7,999,628 proposes a circuit configuration for a bias generation circuit having a relatively small area but having the ability to generate a low-noise bias voltage.

However, implementation of a bias generation circuit of the type disclosed in U.S. Pat. No. 7,999,628 requires, as one of its essential circuit components, a digital controller that carries out a predetermined procedure of control to determine the bias voltage. This leads to an increase in the number of design process steps to perform and/or an increase in the overall chip area.

In addition, generally speaking, a bias generating section controls the bias voltage by varying the resistance value of a variable resistor section. Thus, as the bias voltage is controlled, the impedance varies accordingly, which increases the chances of causing a variation in supply voltage and an error in voltage caused by such a variation. In addition, it is also difficult to increase the resolution sufficiently by defining a predetermined voltage range between the power supply and the ground to be the output range through division of the resistance.

Furthermore, when turned ON, a switch for controlling the resistance value of the variable resistor section allows a steady-state current to flow through it. Thus, CMOS transistors forming this switch would generate a flicker noise by themselves.

In view of the foregoing background, it is therefore an object of the present disclosure to provide a bias generator circuit which may generate a desired bias voltage or bias current using a simple configuration even without such a digital controller that carries out a predetermined procedure of control.

SUMMARY

An aspect of the present disclosure is a bias generator circuit including: a voltage generator circuit for increasing or decreasing an output voltage thereof in accordance with the number of clock cycles of a given clock signal; a comparator for comparing the output voltage of the voltage generator circuit to a reference voltage; a clock generator for generating the clock signal; and a clock gating circuit for receiving, as a control signal, output of the comparator and controlling, in accordance with the control signal, whether or not to pass the clock signal supplied from the clock generator to the voltage generator circuit. The output voltage of the voltage generator circuit is output as a bias voltage.

According to this aspect, the voltage generator circuit increases or decreases its output voltage in accordance with the number of clock cycles of a given clock signal. The clock gating circuit receives, as a control signal, output of the comparator that compares the output voltage of the voltage generator circuit to a reference voltage, and controls, in accordance with the control signal, whether or not to pass the clock signal to the voltage generator circuit. For example, if the voltage generator circuit increases its output voltage, the clock gating circuit stops outputting the clock signal when the output of the comparator indicates that the output voltage of the voltage generator circuit has exceeded the reference voltage. As a result, the output voltage of the voltage generator circuit, i.e., a bias voltage, is set to a value close to the reference voltage. Thus, a desired bias voltage may be generated by such a voltage generator circuit for increasing or decreasing an output voltage thereof in accordance with the number of clock cycles and a simple configuration for controlling the supply of the clock signal to the voltage generator circuit based on the reference voltage.

Another aspect of the present disclosure is a bias generator circuit including: a voltage generator circuit for increasing or decreasing an output voltage thereof in accordance with the number of clock cycles of a given clock signal; a first transistor for generating a reference current; a second transistor for receiving the output voltage of the voltage generator circuit at its gate and the reference current at its drain; a clock generator for generating the clock signal; a clock gating circuit for receiving, as a control signal, a drain voltage of the second transistor and controlling, in accordance with the control signal, whether or not to pass the clock signal supplied from the clock generator to the voltage generator circuit; and a third transistor for receiving the output voltage of the voltage generator circuit at its gate and outputting a bias current from its drain.

According to this aspect, the voltage generator circuit increases or decreases its output voltage in accordance with the number of clock cycles of a given clock signal. The clock gating circuit receives, as a control signal, a drain voltage of the second transistor that receives the output voltage of the voltage generator circuit at its gate and the reference current at its drain, and controls, in accordance with the control signal, whether or not to pass the clock signal to the voltage generator circuit. For example, if the voltage generator circuit increases its output voltage, the clock gating circuit stops outputting the clock signal when an increase in the drain current of the second transistor causes a decrease in its drain voltage. As a result, the drain current of the third transistor receiving the output voltage of the voltage generator circuit at its gate, i.e., a bias current, is set to a value close to the reference current. Thus, a desired bias current may be generated by such a voltage generator circuit for increasing or decreasing an output voltage thereof in accordance with the number of clock cycles and a simple configuration for controlling the supply of the clock signal to the voltage generator circuit based on the reference current.

In an embodiment of each of these two aspects, the voltage generator circuit may include: an output terminal for outputting the output voltage; a resistor bank in which a plurality of resistors are connected together in series and to which a predetermined voltage is applied between both ends thereof a plurality of switches, each of which is selectively turned ON or OFF and has one of two terminals thereof connected to an associated resistor node in the resistor bank and the other terminal thereof connected to the output terminal; and a switch selector section for receiving the clock signal and selectively turning ON any one of the plurality of switches according to the number of clock cycles of the clock signal.

According to such an embodiment, the voltage generator circuit is implemented to include a resistor bank to which a predetermined voltage is applied between both ends thereof; and a plurality of switches, each of which has one of two terminals thereof connected to an associated resistor node in the resistor bank and the other terminal thereof connected to the output terminal. This reduces a variation in supply voltage and an error in voltage caused by the variation in supply voltage, and also reduces the flicker noise.

In another embodiment of each of these two aspects, the voltage generator circuit may include: a digital-to-analog converter for converting a digital signal into an analog signal; and a counter for counting the number of clock cycles of the clock signal, and output of the counter may be supplied to the digital-to-analog converter, and output of the digital-to-analog converter may be delivered as the output voltage.

According to such an embodiment, the voltage generator circuit may be comprised of a counter for counting the number of clock cycles and a digital-to-analog converter receiving the output of the counter as its input, which allows a significant reduction in circuit size.

According to the present disclosure, a desired bias voltage or bias current may be generated by a simple configuration even without a digital controller that carries out a predetermined procedure of control.

BRIEF DESCRIPTION OF THE DRAWINGS

FIGS. 5A and 5B conceptually illustrate how to set resistance values in the voltage generator circuit shown in FIG. 4.

FIGS. 6A and 6B are graphs showing variations in the output voltage of the voltage generator circuit shown in FIG. 4.

DETAILED DESCRIPTION

Embodiments of the present disclosure will now be described with reference to the drawings. Note that in the following description of embodiments, when some element is "connected to" another element, those two elements may naturally be directly connected together but may also be indirectly connected together via a third element (e.g., a capacitor, a transistor, a logic gate, or a circuit). Likewise, when a signal is "input" or "supplied" from some element to another, the signal may naturally be directly transmitted from the former to the latter, but may also be indirectly passed between them via any such third element.

First Embodiment

Figure 1:
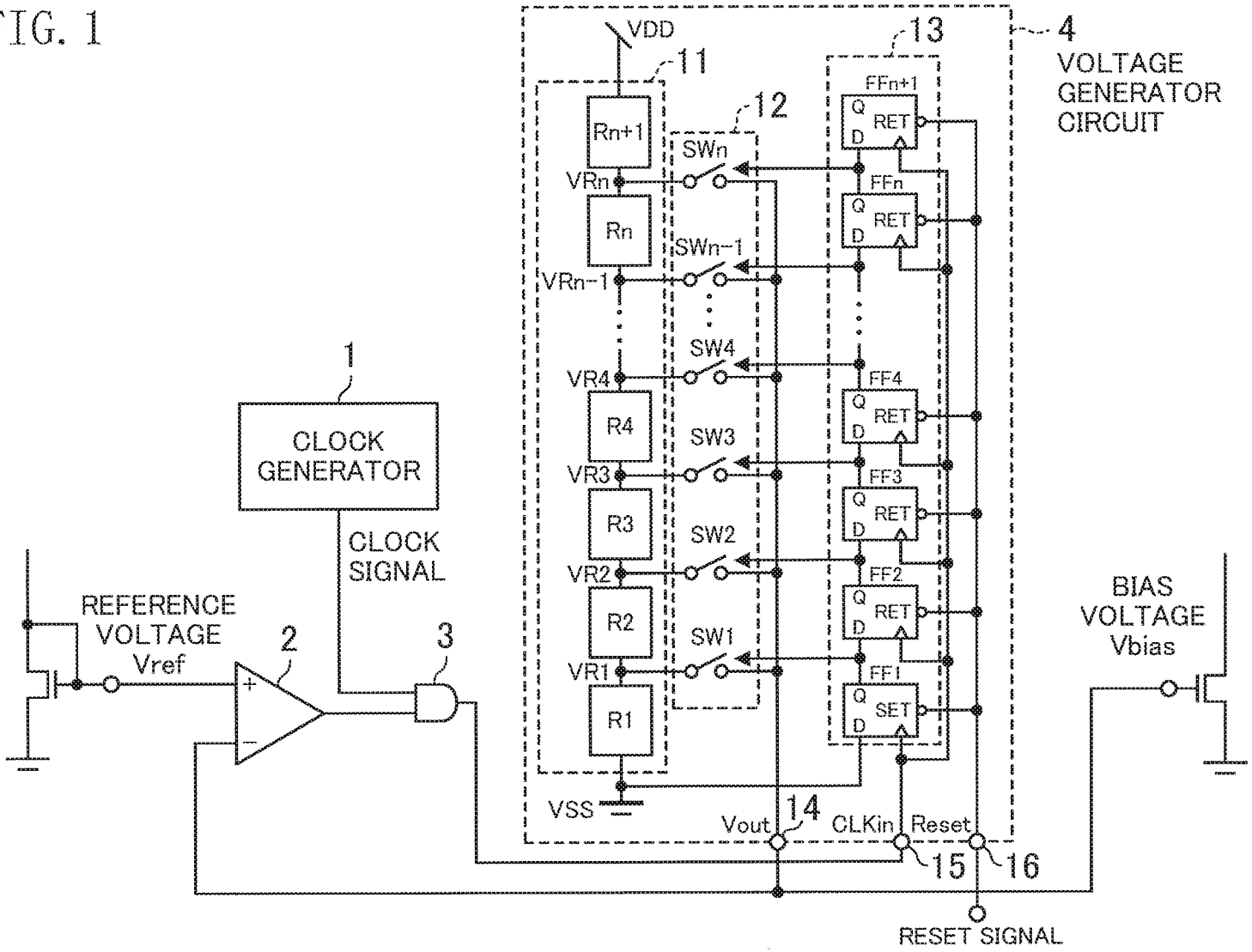
FIG. 1 is a circuit diagram illustrating a configuration for a bias generator circuit according to a first embodiment.

FIG. 1 is a circuit diagram illustrating a configuration for a bias generator circuit according to a first embodiment. A bias generator circuit according to this embodiment includes a clock generator 1 for generating a clock signal, a comparator 2 for comparing two input voltages to each other, an AND gate 3 functioning as a clock gating circuit for either allowing the clock signal to pass through it, or blocking it, in accordance with a control signal, and a voltage generator circuit 4 for either increasing or decreasing its output voltage in accordance with the input clock signal.

Specifically, the comparator 2 receives a reference voltage Vref at its non-inverting input terminal and a voltage Vout, which is the output voltage of the voltage generator circuit 4, at its inverting input terminal. That is to say, the comparator 2 compares the output voltage Vout of the voltage generator circuit 4 to the reference voltage Vref. The AND gate 3 receives a clock signal supplied from the clock generator 1 at one of two input terminals thereof and an output signal of the comparator 2 at the other input terminal thereof. The output of the AND gate 3 is supplied as a clock signal CLKin to a clock input terminal 15 of the voltage generator circuit 4. That is to say, the AND gate 3 receives the output of the comparator 2 as a control signal and determines, in accordance with this control signal, whether or not to pass the clock signal from the clock generator 1 to the voltage generator circuit 4. The output voltage Vout of the voltage generator circuit 4 is output as a bias voltage Vbias.

The voltage generator circuit 4 includes: a resistor bank 11 comprised of a plurality of resistors R1-Rn+1 that are connected together in series; a group of switches 12 comprised of a plurality of switches SW1-SWn, each of which may be selectively turned ON or OFF; and a shift register 13 functioning as a switch selector section for selecting, responsive to the clock signal CLKin, any one of the switches SW1-SWn to turn ON. In the group of switches 12, each of the switches SW1-SWn has one of two terminals thereof connected to an associated one of resistor nodes VR1-VRn in the resistor bank 11 and has the other terminal thereof connected to the output terminal 14. The shift register 13 is comprised of a plurality of flip-flops FF1-FFn+1.

In this description, a reference sign beginning with V in the resistor bank not only refers herein to a resistor node, i.e., either of two terminals of one of the resistors that form the resistor bank, but also represents the value of a voltage at the resistor node.

The resistor bank 11 is connected between a high-potential power supply VDD and a low-potential power supply VSS, and has a predetermined voltage applied between both ends thereof. Appropriately setting the respective resistance values of the two terminal resistors R1 and Rn+1 and the total resistance value of the other resistors R2-Rn in this resistor bank 11 facilitates changing the range of the output voltage of the voltage generator circuit 4. In addition, changing the number of the other resistors in this resistor bank 11 also facilitates setting the resolution of the output voltage. Each of the flip-flops FF1-FFn+1 that form the shift register 13 receives, at their reset terminal RET or SET, a reset signal Reset supplied through a reset signal terminal 16 to determine the initial state. When receiving the reset signal Reset at the reset terminal RET, the flip-flip has its level reset to Low. On the other hand, when receiving the reset signal Reset at the reset terminal SET, the flip-flip has its level reset to High. Also, the output signal of each of the flip-flops FF1-FFn controls the ON/OFF state of an associated one of the switches SW1-SWn. Then, the voltage at a resistor node in the resistor bank 11, to which an ON-state one of the switches in the group 12 is connected, is output as an output voltage Vout through the output terminal 14.

In this embodiment, the voltage generator circuit 4 is configured to increase the output voltage Vout as the number of clock cycles of the given clock signal CLKin increases.

Next, it will be described how the bias generator circuit shown in FIG. 1 operates. First, in response to a reset signal Reset, the output of the flip-flop FF1 goes High and the respective outputs of the other flip-flops FF2-FFn+1 go Low in the shift register 13, thus turning ON the switch SW1 in the group of switches 12. As a result, the lowest voltage VR1 is output as the output voltage Vout. In this case, this initial value VR1 is set to be sufficiently lower than a target reference voltage Vref (i.e., VR1<Vref is satisfied). Thus, the output of the comparator 2 goes High and the AND gate 3 allows the clock signal supplied from the clock generator 1 to pass therethrough. In response to this clock signal, the High output sequentially shifts in the shift register 13 of the voltage generator circuit 4. Consequently, as the High output shifts sequentially, output voltages Vout are output in the order of VR1, VR2, VR3, and so on, to increase their levels gradually.

When the output voltage Vout of the voltage generator circuit 4 eventually exceeds the reference voltage Vref, the output of the comparator 2 inverts to Low level, thus causing the AND gate 3 to stop outputting the clock signal. As a result, the output voltage Vout of the voltage generator circuit 4 stops increasing. That is to say, the output voltage Vout of the voltage generator circuit 4 is set to be a voltage close to, and higher than, the reference voltage Vref.

Figure 2:
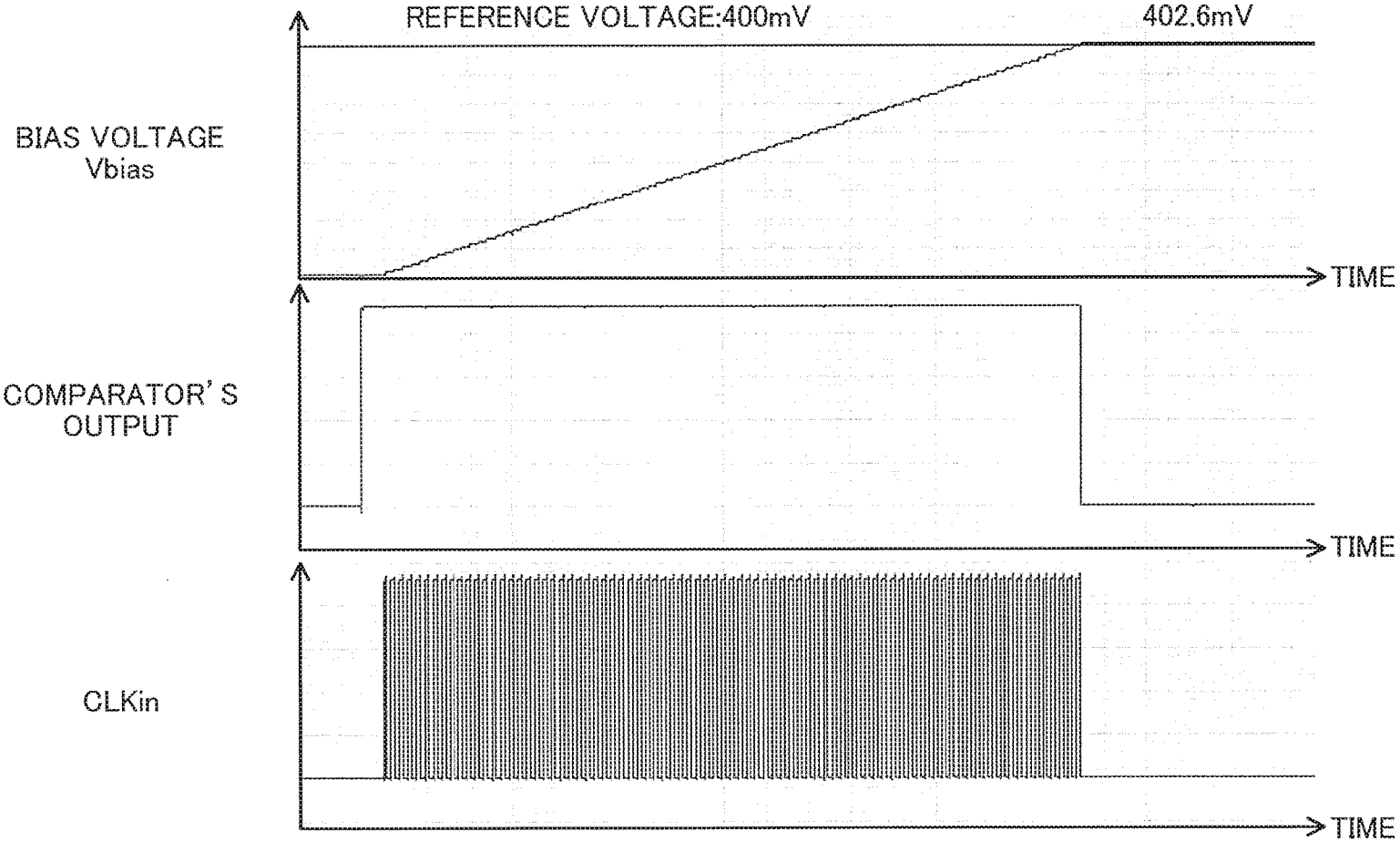
FIG. 2 is a graph showing results of operation simulations of the bias generator circuit shown in FIG. 1.

FIG. 2 shows the results of simulations actually carried out. The voltage generator circuit 4 has an initial value voltage of 0 V and the target reference voltage Vref is 400 mV. As can be seen from FIG. 2, as the number of clock cycles of the clock signal CLKin increases, the output voltage Vout of the voltage generator circuit 4 (i.e., the bias voltage Vbias) gradually increases from 0 V. When the output voltage Vout exceeds the reference voltage Vref of 400 mV, the output of the comparator inverts to Low level, which causes the AND gate 3 to stop outputting the clock signal. As a result, the output voltage of the voltage generator circuit 4 stops increasing. At this time, the output voltage Vout of the voltage generator circuit 4 is set to be 402.6 mV, which is close to, and higher than, the reference voltage of 400 mV. Note that in this simulation, one LSB is approximately 5 mV.

As can be seen from the foregoing description, this embodiment requires no digital controller to perform a predetermined procedure of control in determining the bias voltage, and allows a desired bias voltage to be generated automatically just by applying a clock signal to a sufficiently simple configuration. In addition, the resistor bank 11 connected between the power supply and the ground always has a constant resistance value and operates as a constant current circuit, thus causing no variations in supply voltage or no error in voltage that would otherwise be caused by such variations.

In addition, the switches SW1-SWn of the voltage generator circuit 4 are each used to extract the voltage at an associated resistor node in the resistor bank 11 to the output terminal 14, and therefore, allow no steady-state current to flow therethrough. This may reduce the effect of a flicker noise caused by a switching transistor for the following reason. Specifically, an MOS transistor generates a flicker noise due to a fluctuation with time in the amount of current generated by random traps or releases of carriers to/from lattice defects while a current is flowing through an interface between silicon and an oxide film. Thus, while no current is flowing, the effect of the flicker noise goes zero.

In this embodiment, the voltage generator circuit 4 is configured to have its output voltage increased in accordance with the input clock signal. However, this is only a non-limiting exemplary configuration. Rather the same advantage would also be achieved even if the voltage generator circuit 4 is configured to have its output voltage decreased in accordance with the input clock signal. In that case, the connection between the group of switches 12 and the shift register 13 may be changed, for example, from the one shown in FIG. 1 such that the voltages at the resistor odes of the resistor bank 11 are output in the descending order (i.e., such that the highest voltage is output first, the second highest one next, and so on). Consequently, the voltage generator circuit 4 decreases its output voltage Vout as the number of clock cycles of the given clock signal CLKin increases. Then, the comparator 2 may respectively receive the reference voltage Vref at the inverting input terminal thereof and the output voltage Vout of the voltage generator circuit 4 at the non-inverting input terminal thereof. In such a configuration, setting the initial value VRn of the voltage generator circuit 4 to a voltage sufficiently higher than the reference voltage Vref (i.e., such that VRn>Vref is satisfied) makes the output voltage Vout of the voltage generator circuit 4 close to, and lower than, the reference voltage Vref.

In the embodiment described above, the switch selector section is supposed to be configured as a shift register. However, this is only a non-limiting exemplary embodiment. For example, the switch selector section may also be implemented as a counter instead.

(First Variation)

Figure 3:
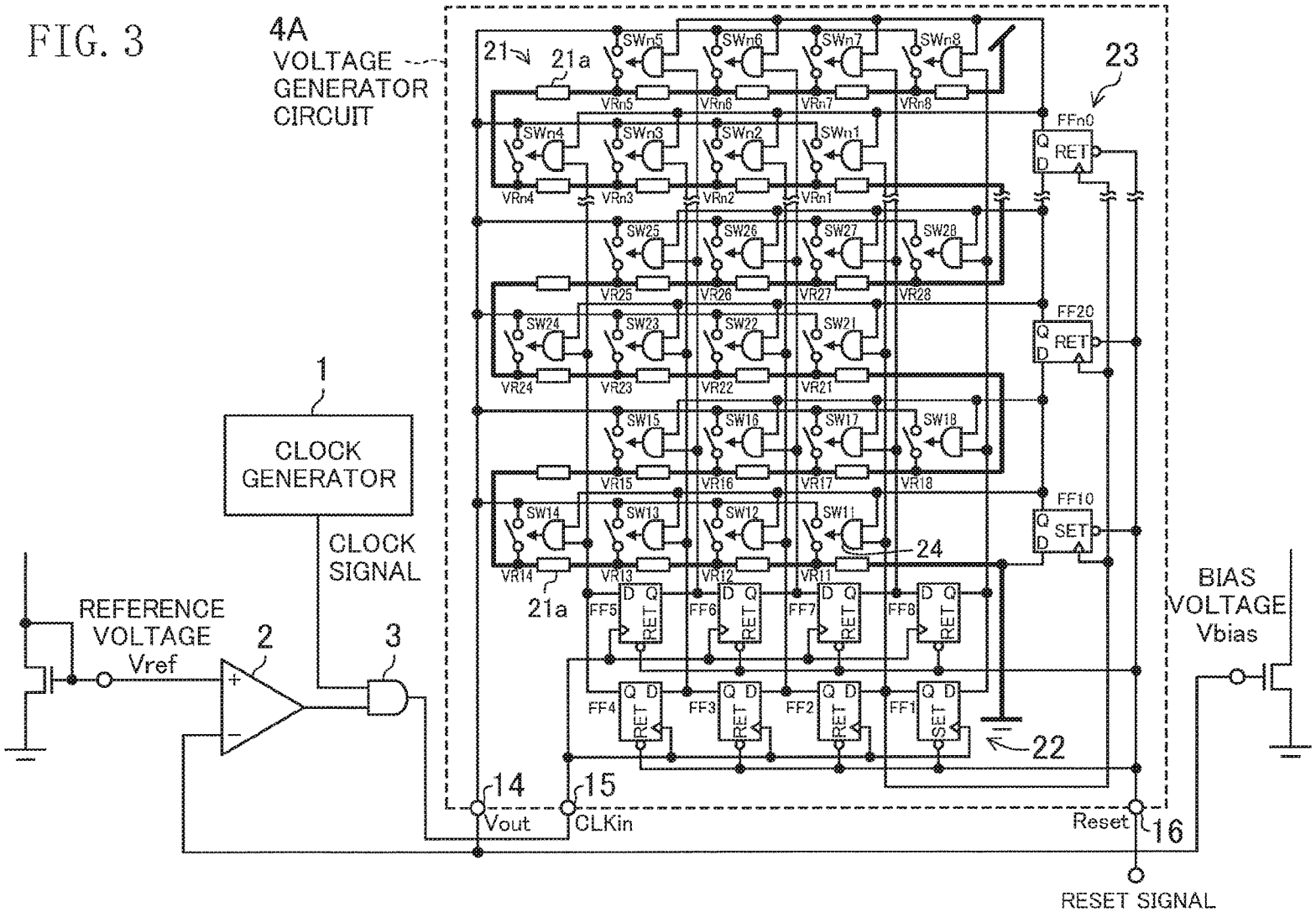
FIG. 3 is a circuit diagram illustrating a configuration for a bias generator circuit according to a first variation of the first embodiment.

FIG. 3 is a circuit diagram illustrating a configuration for a bias generator circuit according to a first variation of the first embodiment. In the variation shown in FIG. 3, the voltage generator circuit has a different configuration from its counterpart shown in FIG. 1. The voltage generator circuit 4 shown in FIG. 1 requires almost as many flip-flops as the switches in order to extract a voltage at a resistor node in the resistor bank 11. Thus, a higher resolution demanded would require the voltage generator circuit 4 to have an increased circuit area. Thus, according to this first variation, the voltage generator circuit 4A is configured to use a decreased number of flip-flops.

In the voltage generator circuit 4A shown in FIG. 3, the resistors 21*a* in the resistor bank 21 are arranged in a zigzag pattern while sequentially changing their orientation in the X-axis direction (i.e., horizontally on the paper). Each of a plurality of switches SW11-SWn8 has one of two terminals thereof connected to an associated one of resistor nodes VR11-VRn8 in the resistor bank 21 and has the other terminal thereof connected to the output terminal 14. Also, the shift register functioning as a switch selector section is separated into two shift registers, namely, a first shift register 22 for the X-axis direction and a second shift register 23 for the Y-axis direction (i.e., arranged vertically on the paper). Specifically, the first shift register 22 for the X-axis direction, functioning as a first selector, is comprised of flip-flops FF1-FF8, and has an overall ring configuration in which the output of the flip-flop F8 is connected to the input of the flip-flop F1. On the other hand, the second shift register 23 for the Y-axis direction, functioning as a second selector, is comprised of flip-flops FF10-FFn0. The first shift register 22 operates in response to the clock signal CLKin and outputs a plurality of first switch select signals. The second shift register 23 operates on receiving one of the output signals of the first shift register 22 (i.e., the output of the flip-flop FF1 in the example illustrated in FIG. 3) and outputs a plurality of second switch select signals.

In addition, an AND circuit 24, which is an exemplary logic circuit, is provided for each of these switches SW11-SWn8. Each AND circuit 24 receives any one of the first switch select signals supplied from the first shift register 22 and any one of the second switch select signals supplied from the second shift register 23, and outputs a signal for controlling the ON/OFF state of that switch.

In this case, any one of the plurality of first switch select signals is supposed to rise to High level (i.e., logic 1), representing a first predetermined logical value, while any one of the plurality of second switch select signals is supposed to rise to High level (i.e., logic 1) representing a second predetermined logical value. The first shift register 22 shifts the plurality of first switch select signals on a rising edge of the clock signal CLKin. The second shift register 23 shifts the plurality of second switch select signals on a rising edge of the output signal of the first shift register 22. Then, an AND circuit 24 that has received first and second switch select signals which are both High (i.e., logic 1) outputs High level (logic 1) as a signal, thereby turning the associated switch ON. Meanwhile, an AND circuit 24 that has received first and second switch select signals, at least one of which is not High (i.e., is logic 0), outputs Low level (logic 0) as a signal, thereby turning the associated switch OFF.

Next, it will be described how the voltage generator circuit 4A shown in FIG. 3 operates. First, in response to a reset signal Reset, the output of the flip-flop FF1 in the first shift register 22 and the output of the flip-flop FF10 in the second shift register 23 go High and the respective outputs of the other flip-flops FF2-FF8 and F0-Fn20 all go Low, thus turning ON the switch SW11 controlled by these flip-flops FF1 and FF10. As a result, a node voltage VR11 is output as the output voltage Vout. Next, when the clock signal CLKin is input, the High output sequentially shifts in the first shift register 22 in the order of FF1, FF2, FF3, and so on. Consequently, as the High output shifts sequentially, node voltages are output in the order of VR11, VR12, VR13, and so on, and the output voltage Vout increases its levels. Eventually, the output of the flip-flop FF8 goes High to output the node voltage VR18. Then, the output of the flip-flop FF1 goes High responsive to the next clock pulse. Thus, on the rising edge of the clock pulse, the High output of the second shift register 23 shifts from the flip-flop FF10 to the flip-flop FF20. As a result, the switch SW21 controlled by the flip-flops FF1 and FF20 turns ON and the node voltage VR21 is output as an output voltage Vout. Thereafter, VR21, VR22, VR23, and so on will be sequentially output responsive to the clock pulses. Once the node voltage VR28 is reached, the output of the flip-flop FF30 goes High responsive to the next clock pulse. After that, VR31, VR32, VR33, and so on will be sequentially output.

As can be seen, the voltages at the resistor nodes in the resistor bank 21 are sequentially output in the ascending order (i.e., such that the lowest voltage is output first, the second lowest next, and so on) as in the voltage generator circuit 4 shown in FIG. 1. In addition, according to this variation, two separate shift registers are provided for the X- and Y-axis directions, respectively, and therefore, the number of flip-flops to provide may be cut down significantly. For example, if the voltage generator circuit 4A shown in FIG. 3 had the configuration of the first embodiment, then as many as 8×n flip-flops would be required. This variation, however, may cut down the number to only (8+n). Consequently, the voltage generator circuit 4A of this variation may have a much smaller circuit size than the counterpart of the first embodiment, and yet easily achieves the advantages of the first embodiment.

Optionally, any one of the plurality of first switch select signals may go Low (logic 0) as a first predetermined logical value. Also, any one of the plurality of second switch select signals may go Low (logic 0) as a second predetermined logical value. In that case, a logic circuit representing the logical values of the first and second switch select signals may be provided for each of the plurality of switches. For example, if any one of the first switch select signals and any one of the second switch select signals both go Low (logic 0), then the AND circuits 24 may be replaced with OR circuits. In that case, an OR circuit that has received first and second switch select signals which are both Low (logic 0) outputs Low (logic 0) as a signal, thereby turning its associated switch ON.

Furthermore, the first shift register 22 may shift the plurality of first switch select signals on a falling edge of the clock signal CLKin, while the second shift register 23 may shift the plurality of second switch select signals on a falling edge of the output signal of the first shift register 22.

(Second Variation)

Figure 4:
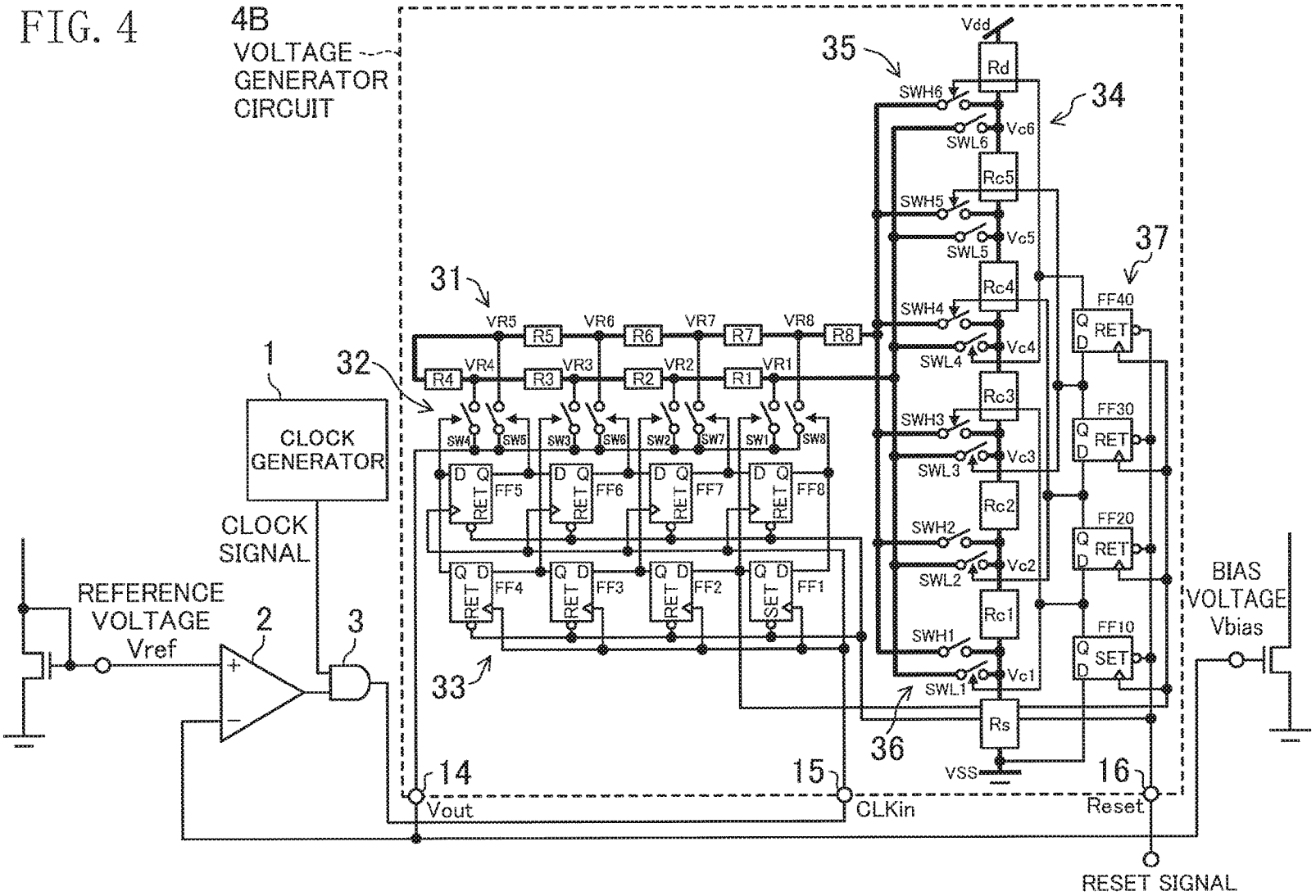
FIG. 4 is a circuit diagram illustrating a configuration for a bias generator circuit according to a second variation of the first embodiment.

FIG. 4 illustrates a configuration for a bias generator circuit according to a second variation of the first embodiment. In the variation shown in FIG. 4, the voltage generator circuit has a different configuration from its counterparts shown in FIGS. 1 and 3. Specifically, the voltage generator circuit 4A shown in FIG. 3 requires as many switches and logic gates as the resistor nodes, from which the voltage is extracted, in order to extract the voltage from the resistor bank 21. On the other hand, the voltage generator circuit 4B of this second variation may require a much smaller number of switches and logic gates.

As shown in FIG. 4, the voltage generator circuit 4B includes: a first resistor bank 31 in which a plurality of resistors R1-R8 are connected together in series; a first group of switches 32 comprised of a plurality of switches SW1-SW8, each of which may be selectively turned ON and OFF; a first shift register 33 functioning as a first switch selector for selectively turning ON any of the switches in the first group 32; a second resistor bank 34 in which a plurality of resistors Rc1-Rc5 are connected together in series; a second group of switches 35 comprised of a plurality of switches SWH1-SWH6, each of which may be selectively turned ON and OFF; a third group of switches 36 comprised of a plurality of switches SWL1-SWL6, each of which may be selectively turned ON and OFF; and a second shift register 37 functioning as a second switch selector for selectively turning ON any of the switches in the second group 35 and any of the switches in the third group 36.

In the first group of switches 32, each of the switches SW1-SW8 has one of two terminals thereof connected to an associated resistor node in the first resistor bank 31 and has the other terminal thereof connected to the output terminal 14. In the second group of switches 35, each of the switches SWH1-SWH6 has one of two terminals thereof connected to an associated resistor node in the second resistor bank 34 and has the other terminal thereof connected to one end of the first resistor bank 31. In the third group of switches 36, each of the switches SWL1-SWL6 has one of two terminals thereof connected to an associated resistor node in the second resistor bank 34 and has the other terminal thereof connected to the other end of the first resistor bank 31.

The first shift register 33 is comprised of flip-flops FF1-FF8, and has a ring configuration in which the output of the flip-flop FF8 is connected to the input of the flip-flop FF1. The first shift register 33 receives the clock signal CLKin, and selectively turns ON any one of the switches SW1-SW8 in the first group of switches 32 according to the number of clock cycles of the clock signal CLKin. That is to say, the first shift register 33 controls the switches SW1-SW8 so as to sequentially output the voltages at the resistor nodes in the first resistor bank 31 in the ascending order (i.e., in the order of VR1, VR2, . . . , VR8, VR1, and so on such that the lowest voltage is output first, the second lowest one next, and so on). On the other hand, the second shift register 37 is comprised of flip-flops FF10-FF40. The second shift register 37 receives any one of the output signals of the first shift register 33 (e.g., the output of the flip-flop FF1 in FIG. 4), and selectively turns ON any one of the switches SWH1-SWH6 in the second group 35 and any one of the switches SWL1-SWL6 in the third group 36 in accordance with the output signal. That is to say, the second shift register 37 controls the switches SWL1-SWL6 and the switches SWH1-SWH6 so as to sequentially connect both ends of the first resistor bank 31 to the resistor nodes in the second resistor bank 34 in the order of (Vc1, Vc3), (Vc2, Vc4), (Vc3, Vc5), and so on. Note that the numbers of resistors in the first and second resistor banks 31 and 34 are not limited to the ones shown in FIG. 4.

Next, it will be described how the voltage generator circuit 4B shown in FIG. 4 operates. In this example, the resistance values of the resistors R1-R8 forming the first resistor bank 31 and those of the resistors Rc1-Rc5 forming the second resistor bank 34 are supposed to satisfy the following equations:

$$R1=R2=R3=R4=R5=R6=R7=R8=Ra$$

$$Rc1=Rc2=Rc3=Rc4Rc5=4Ra$$

That is to say, the sum of the resistance values of the first resistor bank 31 is 8Ra. First, in response to a reset signal Reset, the output of the flip-flop FF10 goes High, thus turning the switches SWL1 and SWH3 ON. As a result, both ends of the first resistor bank 31 are respectively connected to the resistor nodes Vc1 and Vc3 in the second resistor bank 34. In this case, the value of the resistance between the resistor nodes Vc1 and Vc3 is 8Ra (=Rc1+Rc2), which is equal to the total resistance value of 8Ra of the first resistor bank 31. Thus, the combined resistance value thereof is 8Ra/2=4Ra, which is as high as the resistance value of the resistors Rc3-Rc5. As a result, the voltage between the resistor nodes Vc1 and Vc6 is equally divided into four by four resistors, each having the same resistance value of 4Ra. In the lowest voltage range Vc1-Vc3 among these four equally divided voltage ranges, the voltages VR1-VR8 equally divided into eight by the first resistor bank 31 are sequentially output by the voltage generator circuit 4B as the number of clock cycles of the clock signal CLKin increases such that the lowest voltage is output first, the second lowest one next, and so on.

After the voltage VR8 has been output, the switch SW1 turns ON, and High output in the second shift register 37 shifts from the flip-flop FF10 to the flip-flop FF20, in response to the next clock pulse. As a result, switches SWL2 and SWH4 turn ON and both ends of the first resistor bank 31 are respectively connected to the resistor nodes Vc2 and Vc4 in the second resistor bank 34. As in the situation described above, the value of the resistance between the resistor nodes Vc2 and Vc4 is 8Ra (=Rc2+Rc3), and the combined resistance value with the first resistor bank 31 is 4Ra. As a result, the voltage between the resistor nodes Vc1 and Vc6 is equally divided into four by four resistors, each having the same resistance value of 4Ra. In the second lowest voltage range Vc2-Vc4 among these four equally divided voltage ranges, the voltages VR1-VR8 equally divided into eight by the first resistor bank 31 are sequentially output by the voltage generator circuit 4B as the number of clock cycles of the clock signal CLKin increases such that the lowest voltage is output first, the second lowest one next, and so on.

As can be seen, the voltage generator circuit 4B shown in FIG. 4, as well as the voltage generator circuits 4 and 4A shown in FIGS. 1 and 3, may also increase its output voltage as the number of clock cycles of the given clock signal increases. In addition, this variation may significantly cut down not only the number of flip-flops to use but also the numbers of switches and logic gates to use as well.

Furthermore, the constant impedance (of 16Ra in FIG. 4) between the resistor nodes Vc1 and Vc6 causes neither any steady-state variations in supply voltage nor any error in voltage that would otherwise be caused by such variations. Besides, arrangement of appropriate resistors Rd and Rs at both ends of the second resistor bank 34 allows an arbitrary regulation of the output voltage range, thus facilitating resolution enhancement through optimization of the output range. Moreover, according to this variation, the voltage generator circuit allows a current to flow through only two switches (i.e., switches that connect both ends of the first resistor bank 31 to the second resistor bank 34) during its operation. This may minimize the effect of a flicker noise caused by the switching transistors.

Optionally, according to this variation, the resistance values may also be set to satisfy $$R1=R2=R3=R4=R5=R6=R7=R8>Ra$$

$$Rc1=Rc2=Rc3=Rc4=Rc5=4Ra$$

In that case, the sum of the resistance values of the first resistor bank 31 is greater than the sum of the resistance values of two resistors in the second resistor bank 34. Thus, the combined resistance thereof is greater than the resistance value of 4Ra of each resistor in the second resistor bank 34. As a result, the connection between the first and second resistor banks 31 and 34 switches, and a shifted output voltage range of the first resistor bank 31 comes to overlap with the voltage range before the shift. This may check the expansion of the error due to a variation in resistance.

This advantage will be described with reference to FIGS. 5A, 5B, 6A, and 6B. FIGS. 5A and 5B conceptually illustrate how to set the resistance values in the voltage generator circuit 4B shown in FIG. 4. FIGS. 6A and 6B are graphs showing variations in the output voltage of the voltage generator circuit 4B. In FIG. 5A, the total resistance value of the first resistor bank 31 is supposed to be 2R and the resistance value of each resistor in the second resistor bank 34 is supposed to be R. In that case, when both ends of the first resistor bank 31 are connected to the two terminals of two resistors in the second resistor bank 34, the combined resistance value thereof is R. Thus, the voltage range Va1-Va5 corresponding to the first resistor bank 31 is obtained by equally dividing the entire voltage range (e.g., into five in FIG. 5). In that case, the output voltage of the voltage generator circuit 4B increases monotonically as the number of clock cycles increases.

In FIG. 5B, on the other hand, the total resistance value of the first resistor bank 31 is set to be greater than 2R. In that case, when both ends of the first resistor bank 31 are connected to the two terminals of two resistors in the second resistor bank 34, the combined resistance value thereof is greater than R. As a result, the voltage range Vb1-Vb5 corresponding to the first resistor bank 31 is slightly broader than the voltage range Va1-Va5 shown in FIG. 5A, and two adjacent voltage ranges overlap with each other. In this case, as shown in FIG. 6B, the output voltage of the voltage generator circuit 4B generally increases as the number of clock cycles increases. When observed microscopically, however, the graph has some local portions with decreasing output voltages.

Ideally, the output voltage of a voltage generator circuit either monotonically increases or monotonically decreases by a predetermined magnitude of variation in accordance with the number of clock cycles. Actually, however, as the resistance value varies, the magnitude of variation sometimes fluctuates (i.e., either increases or decreases) from a predetermined value. Such an error increases every time the connection between the first and second resistor banks 31 and 34 switches. Also, if the sum of the resistance values of the first resistor bank 31 is less than the sum of resistance values of two resistors in the second resistor bank 34, there will be a gap between two adjacent voltage ranges corresponding to the first resistor bank 31, thus making the output voltage no longer finely regulable. As a result, the precision of output voltage setting may possibly decrease. In contrast, setting the resistance values in advance such that adjacent voltage ranges overlap with each other as shown in FIG. 5B allows no gap to be left between two adjacent voltage ranges even when the resistance value varies, thus enabling the avoidance of a decline in the precision of the output voltage setting.

Note that according to the present disclosure, the voltage generator circuit increases or decreases its output voltage in accordance with the number of clock cycles. However, the relationship between the number of clock cycles and the output voltage may have some portions where the gradually increasing or decreasing output voltage temporarily changes in reverse direction as shown in FIG. 6B, for example. That is to say, the voltage generator circuit may generally increase its output voltage gradually as the number of clock cycles increases, but may have such a number of clock cycles-output voltage relationship that allows the output voltage to temporarily decrease as the number of clock cycles increases. Alternatively, the voltage generator circuit may also generally decrease its output voltage gradually as the number of clock cycles increases, but may have such a number of clock cycles-output voltage relationship that allows the output voltage to temporarily increase as the number of clock cycles increases.

(Third Variation)

Figure 7:
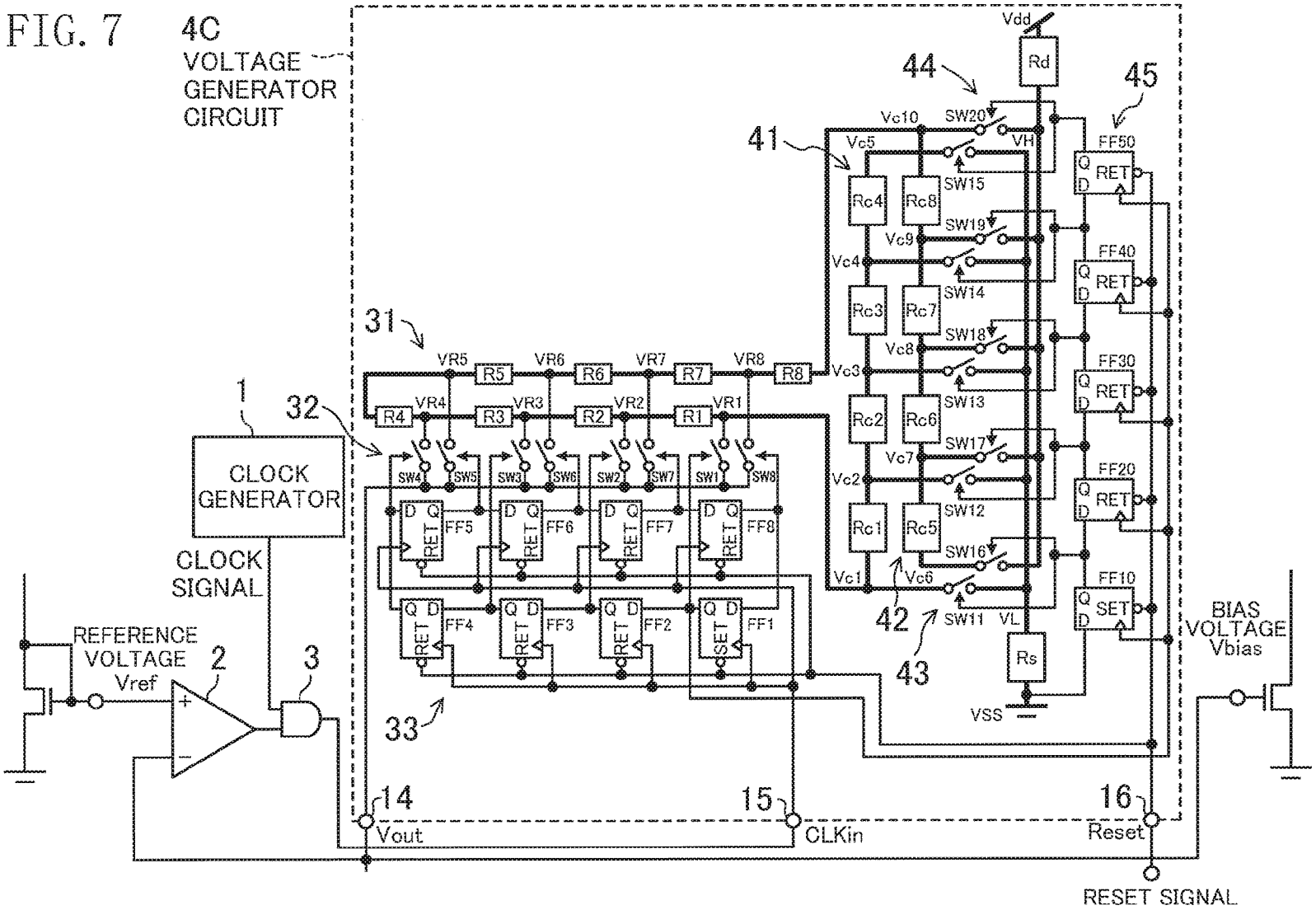
FIG. 7 is a circuit diagram illustrating a configuration for a bias generator circuit according to a third variation of the first embodiment.

FIG. 7 illustrates a configuration for a bias generator circuit according a third variation of the first embodiment. Just like its counterpart shown in FIG. 4, the voltage generator circuit 4C shown in FIG. 7 is also configured to significantly cut down the number of switches and logic gates to use.

As shown in FIG. 7, the voltage generator circuit 4C, as well as the voltage generator circuit 4B shown in FIG. 4, includes: a first resistor bank 31 in which a plurality of resistors R1-R8 are connected together in series; a first group of switches 32 comprised of a plurality of switches SW1-SW8, each of which may be selectively turned ON and OFF; a first shift register 33 functioning as a first switch selector for selectively turning ON any of the switches in the first group 32; a second resistor bank 41 in which a plurality of resistors Rc1-Rc4 are connected together in series; a third resistor bank 42 in which a plurality of resistors Rc5-Rc8 are connected together in series; a second group of switches 43 comprised of a plurality of switches SW11-SW15, each of which may be selectively turned ON and OFF; a third group of switches 44 comprised of a plurality of switches SW16-SW20, each of which may be selectively turned ON and OFF; and a second shift register 45 for selectively turning ON any of the switches in the second group 43 and any of the switches in the third group 44. One end of the second resistor bank 41 is connected to one end of the first resistor bank 31. One end of the third resistor bank 42 is connected to the other end of the first resistor bank 31.

In the first group of switches 32, each of the switches SW1-SW8 has one of two terminals thereof connected to an associated resistor node in the first resistor bank 31 and has the other terminal thereof connected to the output terminal 14. In the second group of switches 43, each of the switches SW11-SW15 has one of two terminals thereof connected to an associated resistor node in the second resistor bank 41 and has the other terminal thereof connected to a terminal VL functioning as a low-potential supply terminal. In the third group of switches 44, each of the switches SW16-SW20 has one of two terminals thereof connected to an associated resistor node in the third resistor bank 42 and has the other terminal thereof connected to a terminal VH functioning as a high-potential supply terminal.

The first shift register 33 is comprised of flip-flops FF1-FF8, and has a ring configuration in which the output of the flip-flop FF8 is connected to the input of the flip-flop FF1. The first shift register 33 receives the clock signal CLKin, and selectively turns ON any one of the switches SW1-SW8 in the first group 32 according to the number of clock cycles of the clock signal CLKin. That is to say, the first shift register 33 controls the switches SW1-SW8 so as to sequentially output the voltages at the resistor nodes of the first resistor bank 31 in the ascending order (i.e., in the order of VR1, VR2, . . . , VR8, VR1, and so on such that the lowest voltage is output first, the second lowest voltage next, and so on). On the other hand, the second shift register 45 is comprised of flip-flops FF10-FF50. The second shift register 45 receives any one of the output signals of the first shift register 33 (e.g., the output of the flip-flop FF1 in FIG. 7), and selectively turns ON any one of the switches SW11-SW15 in the second group 43 and any one of the switches SW16-SW20 in the third group 44 in accordance with the output signal. That is to say, the second shift register 45 controls the switches SW11-SW20 so as to connect the resistor nodes Vc1-Vc5 of the second resistor bank 41 to the terminal VL and to connect the resistor nodes Vc6-Vc10 of the third resistor bank 42 to the terminal VH in the order of (Vc1, Vc6), (Vc2, Vc7), (Vc3, Vc8), and so on. Note that the numbers of resistors in the first, second and third resistor banks 31, 41, and 42 are not limited to the ones shown in FIG. 7.

Next, it will be described how the voltage generator circuit 4C shown in FIG. 7 operates. In this example, the resistance values of the resistors R1-R8 forming the first resistor bank 31 and those of the resistors Rc1-Rc8 forming the second and third resistor banks 41, 42 are supposed to satisfy the following equations:

$$R1=R2=R3=R4=R5=R6=R7=R8=Ra$$

$$Rc1=Rc2=Rc3=Rc4=Rc5=Rc6=Rc7=Rc8=8Ra$$

That is to say, the sum of the resistance values of the first resistor bank 31 is 8Ra, which is equal to the resistance value of each resistor in the second and third resistor banks 41 and 42. First, in response to a reset signal Reset, the output of the flip-flop FF10 goes High, thus turning the switches SW11 and SW16 ON. Consequently, the resistor node Vc1 of the second resistor bank 41 gets connected to the terminal VL, and the resistor node Vc6 of the third resistor bank 42 gets connected to the terminal VH. As a result, the voltage between the terminals VL and VH is equally divided into five by the first resistor bank 31 and the resistors Rc5-Rc8. In the lowest voltage range Vc1-Vc10 among these five equally divided voltage ranges, the voltages VR1-VR8 equally divided into eight by the first resistor bank 31 are sequentially output by the voltage generator circuit 4C as the number of clock cycles of the clock signal CLKin increases such that the lowest voltage is output first, the second lowest one next, and so on.

After the voltage VR8 has been output, the switch SW1 turns ON, and High output in the second shift register 45 shifts from the flip-flop FF10 to the flip-flop FF20, in response to the next clock pulse. As a result, switches SW12 and SW17 turn ON, the resistor node Vc2 in the second resistor bank 41 gets connected to the terminal VL, and the resistor node Vc7 in the third resistor bank 42 gets connected to the terminal VH. As a result, the voltage between the terminals VL and VH is equally divided into five by the resistor Rc1, the first resistor bank 31, and the resistors Rc6-Rc8 this time. In the second lowest voltage range Vc1-Vc10 among these five equally divided voltage ranges, the voltages VR1-VR8 equally divided into eight by the first resistor bank 31 are sequentially output by the voltage generator circuit 4C as the number of clock cycles of the clock signal CLKin increases such that the lowest voltage is output first, the second lowest one next, and so on.

As can be seen, the voltage generator circuit 4C shown in FIG. 7, as well as the voltage generator circuits 4, 4A shown in FIGS. 1 and 3, may also increase its output voltage the number of clock cycles of the given clock signal increases. In addition, this variation may significantly cut down not only the number of flip-flops to use but also the numbers of switches and logic gates to use as well.

Furthermore, the constant impedance (of e.g., 40Ra in FIG. 7) between the terminals VL and VH causes neither any steady-state variations in supply voltage nor any error in voltage that would otherwise be caused by such variations. Besides, arrangement of appropriate resistors Rd and Rs between the high-potential power supply Vdd and the terminal VH and between the low-potential power supply Vss and the terminal VL, respectively, allows an arbitrary regulation of the output voltage range, thus facilitating resolution enhancement through optimization of the output range. Moreover, according to this variation, the voltage generator circuit 4C allows a current to flow through only two switches (i.e., a switch connecting the second resistor bank 41 to the terminal VL and a switch connecting the third resistor bank 42 to the terminal VH) during its operation. This may minimize the effect of a flicker noise caused by the switching transistors.

Optionally, according to this variation, the resistance values may also be set to satisfy $$R1=R2=R3=R4=R5=R6=R7=R8>Ra$$

$$Rc1=Rc2=Rc3=Rc4=Rc5=Rc6=Rc7=Rc8=8Ra$$

In that case, the sum of the resistance values of the first resistor bank 31 is greater than the resistance value of 8Ra of each resistor in the second and third resistor banks 41 and 42. As a result, the connection between the first, second, and third resistor banks 31, 41, and 42 switches, and a shifted output voltage range of the first resistor bank 31 comes to overlap with the voltage range before the shift. This may check the expansion of the error due to a variation in resistance as already described for the second variation.

The voltage generator circuits 4A, 4B, and 4C according to the first, second and third variations described above are each configured to increase their output voltage as the number of clock cycles increases. However, these voltage generator circuits 4A, 4B, and 4C may also be readily modified to decrease their output voltage as the number of clock cycles increases, just like the voltage generator circuit 4 shown in FIG. 1.

Also, in the first to third variations described above, the switch selector section is supposed to be implemented as a shift register. However, this is only an example of the present disclosure. Alternatively, the switch selector section may also be configured as a counter, for example.

Second Embodiment

Figure 8:
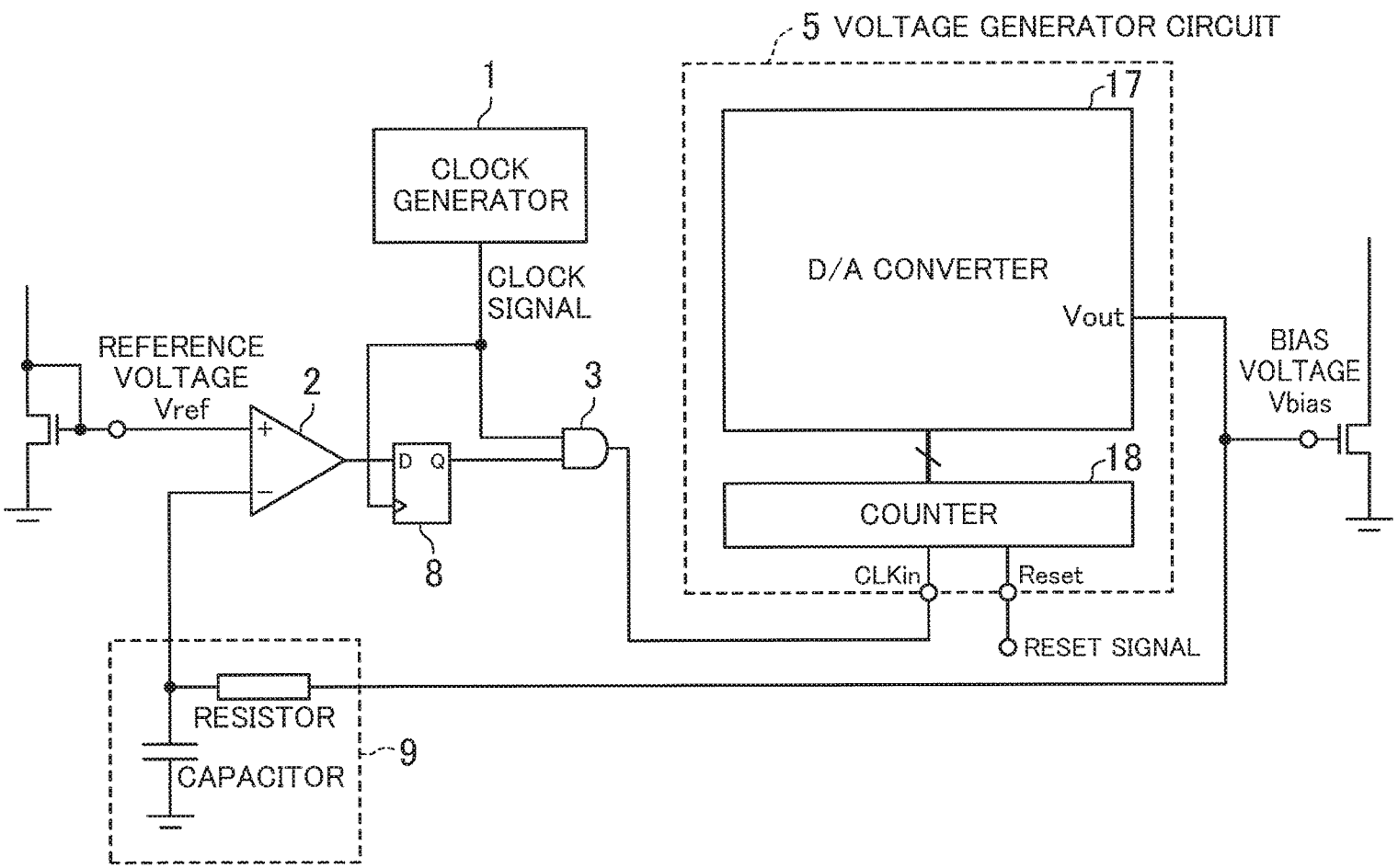
FIG. 8 is a circuit diagram illustrating a configuration for a bias generator circuit according to a second embodiment.

FIG. 8 is a circuit diagram illustrating a configuration for a bias generator circuit according to a second embodiment. In FIG. 8, any component having substantially the same function as its counterpart shown in FIG. 1 is identified by the same reference numeral as the counterpart's. The configuration and operation of this embodiment are basically the same as what has already been described for the first embodiment. Thus, the following description of the second embodiment will be focused on differences from the first embodiment.

The voltage generator circuit 5 shown in FIG. 8 includes a digital-to-analog (D/A) converter 17 for converting a digital signal into an analog signal and a counter 18 for counting the number of clock cycles of the clock signal CLKin. Output data of the counter 18 is supplied to the D/A converter 17, the output of which is delivered as an output voltage Vout.

This configuration allows the voltage generator circuit 5 to increase or decrease the output voltage Vout of the D/A converter 17 on a grayscale level basis in accordance with the number of clock cycles. In addition, the voltage generator circuit 5 may also be implemented to have a smaller area than the first embodiment. Any type of D/A converter 17 may be used. However, it is recommended that a D/A converter causing as little noise as possible such as an R-2R type, for example, be used.

In addition, according to the configuration shown in FIG. 8, a flip-flop 8 is arranged on the output end of the comparator 2, i.e., on the control signal input end of the clock gating circuit, so as to receive the output of the comparator 2, i.e., the result of comparison made by the comparator 2, in sync with the clock signal. This is done to reduce an error to be caused by a glitch (i.e., a spike noise generated when the mode of output is switched), which is significant particularly when the D/A converter 17 is used in the voltage generator circuit 5. For example, the output of the voltage generator circuit 5 is changed on a falling edge of the clock signal and the result of comparison made by the comparator 2 is loaded into the flip-flop 8 on a rising edge thereof which is half a clock cycle later than the falling edge. This reduces the likelihood of the voltage generator circuit's 5 malfunctioning due to a glitch caused by a change of the output voltage Vout of the voltage generator circuit 5. This is because noise generated by the glitch will substantially converge half a clock cycle later than a change of the output voltage Vout. Also, according to the configuration shown in FIG. 8, a low-pass filter 9 is provided on a path for transmitting the output voltage Vout of the voltage generator circuit 5 to an input terminal of the comparator 2. This low-pass filter 9 contributes to reducing the glitch itself.

As can be seen, this embodiment, as well as the first embodiment described above, eliminates a digital controller for performing a predetermined procedure of control in determining the bias voltage. This enables an automatic generation of a desired bias voltage just by applying a clock signal to a sufficiently simple configuration. In addition, the voltage generator circuit 5 is comprised of the D/A converter 17 and the counter 18. Thus, the circuit size may be reduced significantly compared to the first embodiment. Moreover, this also dramatically reduces the likelihood of the voltage generator circuit's 5 malfunctioning due to a glitch of the output voltage Vout thereof.

Optionally, the flip-flop 8 and low-pass filter 9 of this embodiment may be added to the configuration of the first embodiment shown in FIG. 1, for example. This would also reduce the likelihood of, e.g., the voltage generator circuit's 4 malfunctioning due to a glitch of its output voltage Vout as significantly as in this embodiment.

Third Embodiment

Figure 9:
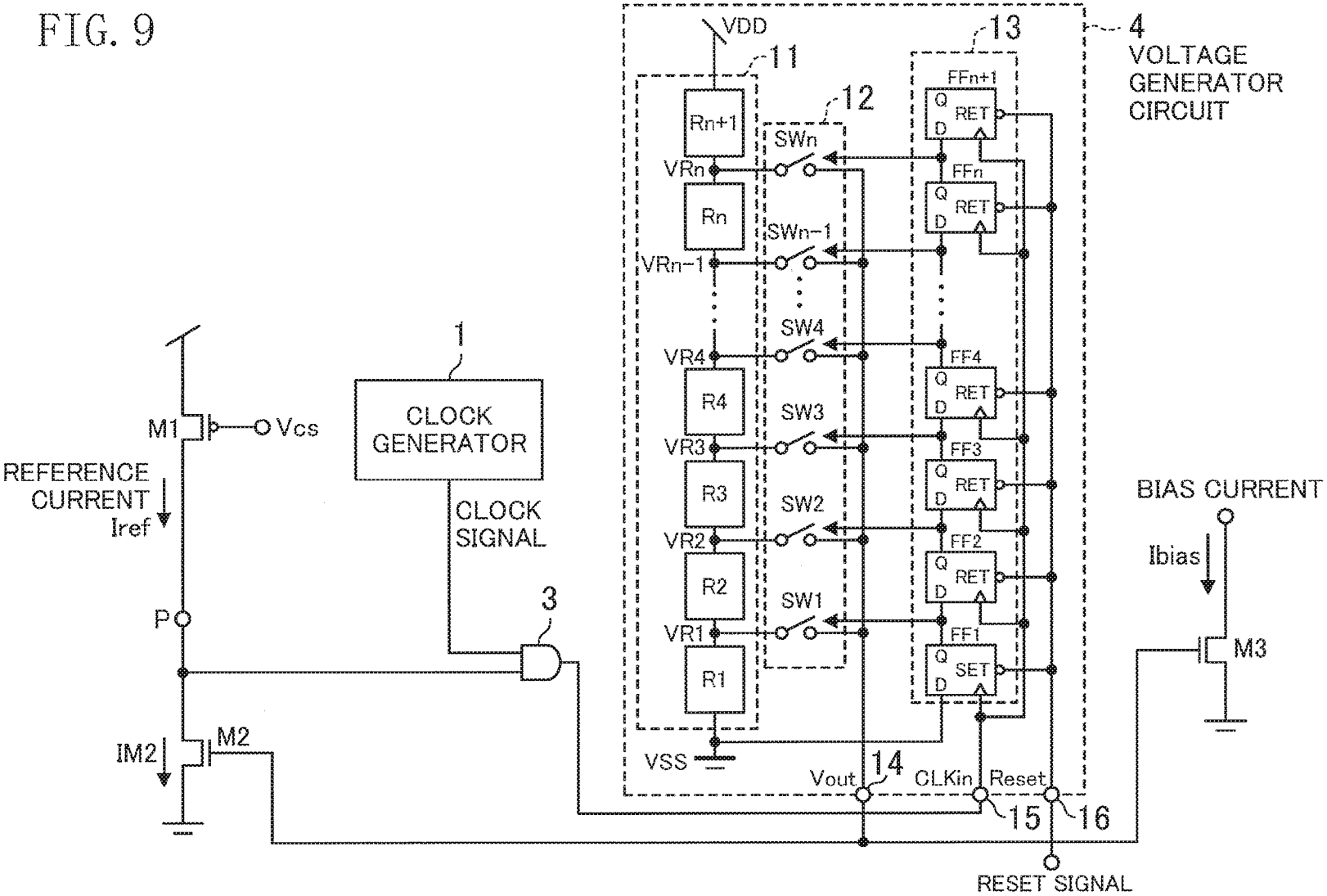
FIG. 9 is a circuit diagram illustrating a configuration for a bias generator circuit according to a third embodiment.

FIG. 9 is a circuit diagram illustrating a configuration for a bias generator circuit according to a third embodiment. The bias generator circuit of this embodiment includes: a clock generator 1 for generating a clock signal; an AND gate 3 functioning as a clock gating circuit for either allowing the clock signal to pass therethrough, or blocking it, in accordance with a control signal; a voltage generator circuit 4 for increasing or decreasing its output voltage in accordance with the input clock signal; a first transistor M1 for generating a reference current Iref; a second transistor M2 for receiving the reference current Iref at its drain; and a third transistor M3 for outputting a bias current Ibias from its drain.

Specifically, the AND gate 3 receives, at one of two input terminals thereof, the clock signal from the clock generator 1, and also receives, at the other input terminal thereof, the drain voltage of the second transistor M2. The output of the AND gate 3 is supplied as a clock signal CLKin to a clock input terminal 15 of the voltage generator circuit 4. That is to say, the AND gate 3 receives the drain voltage of the second transistor M2 as a control signal, and determines, in accordance with this control signal, whether or not to pass the clock signal from the clock generator 1 to the voltage generator circuit 4. The output voltage Vout of the voltage generator circuit 4 is supplied to the respective gates of the second and third transistors M2 and M3.

The voltage generator circuit 4 may have the same configuration as the one shown in FIG. 1, and detailed description thereof will be omitted herein. Alternatively, any of the voltage generator circuits 4A, 4B, and 4C according to the first, second, and third variations of the first embodiment described above may be applied to the configuration shown in FIG. 9.

Next, it will be described how the bias generator circuit shown in FIG. 9 operates. The initial value VR1 of the voltage generator circuit 4 is set such that the drain current IM2 allowed to flow through the second transistor M2 receiving this voltage at the gate is sufficiently smaller than the reference current Iref. First, in response to a reset signal Reset, the output of the flip-flop FF1 goes High and the respective outputs of the other flip-flops FF2-FFn+1 go Low, thus turning ON the switch SW1 in the group of switches 12. As a result, the voltage VR1 is delivered as the output voltage Vout. In this case, Iref>IM2 is satisfied as described above, and therefore, the voltage at the node P receiving the reference current Iref goes High. The AND gate 3, receiving this voltage at one of the two input terminals thereof, allows the clock signal supplied from the clock generator 1 to pass therethrough. In response to this clock signal, the output voltage Vout of the voltage generator circuit 4 gradually rises. When the drain current IM2 allowed to flow through the second transistor M2 exceeds the reference current Iref, the voltage at the node P inverts to Low level. In response, the AND gate 3 stops outputting the clock signal, and the output voltage Vout of the voltage generator circuit 4 stops rising. As a result, the drain current IM2 of the second transistor M2 is set to be close to, and greater than, the reference current Iref.

In this case, if the ratio of the size of the second transistor M2 to that of the third transistor M3 is set to satisfy $$W(M1)/L(M1):W(M2)/L(M2)=1:\alpha$$

then the drain of the third transistor M3 outputs an amount of current αIM2 as a bias current Ibias.

Figure 10:
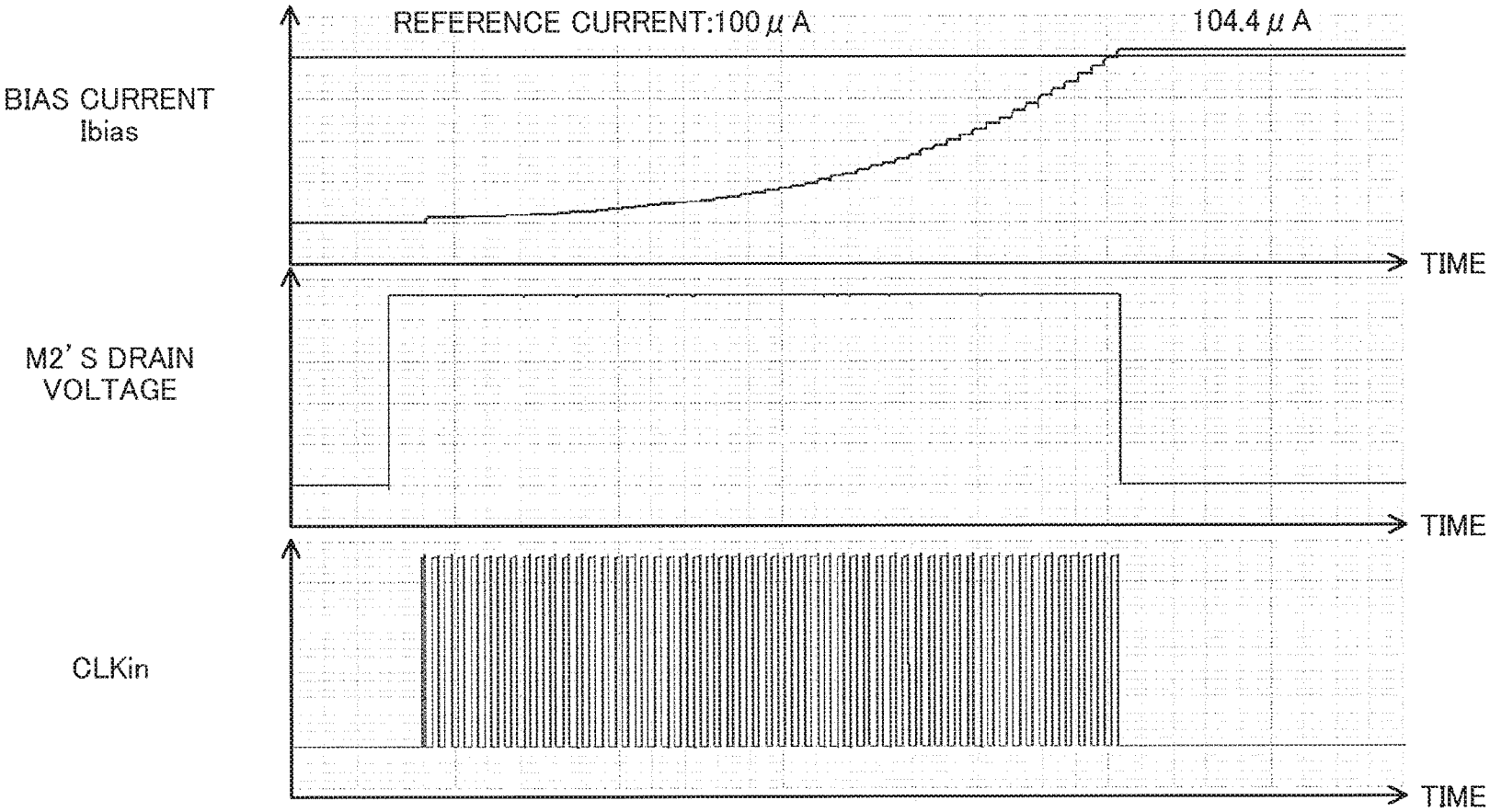
FIG. 10 is a graph showing results of operation simulations of the bias generator circuit shown in FIG. 9.

FIG. 10 shows the results of simulations actually carried out by the present inventor. The voltage generator circuit 4 has an initial value voltage of 0 V, the target reference current Iref is 100 μA, and α is 1. As can be seen from FIG. 10, as the number of clock cycles of the clock signal CLKin increases, the bias current Ibias output from the third transistor M3 increases. When the bias current Ibias exceeds the reference current Iref of 100 μA, the drain voltage of the second transistor M2 inverts to Low level, which causes the AND gate 3 to stop outputting the clock signal. As a result, the bias current Ibias stops increasing, in this case, the bias current Ibias is set to be 104.4 μA, which is close to, and higher than, the reference current of 100 μA.

As can be seen from the foregoing description, this embodiment requires no digital controller to perform a predetermined procedure of control in determining a bias current, and allows a desired bias current to be generated automatically just by applying a clock signal to a sufficiently simple configuration. In addition, as in the configuration of the first embodiment shown in FIG. 1, the resistor bank 11 connected between the power supply and the ground always has a constant resistance value, thus causing no variations in supply voltage or no error in voltage that would otherwise be caused by such variations. Furthermore, the voltage generator circuit 4 allows no steady-state current to flow through the switches, and therefore, may reduce the effect of a flicker noise caused by switching transistors.

Fourth Embodiment

Figure 11:
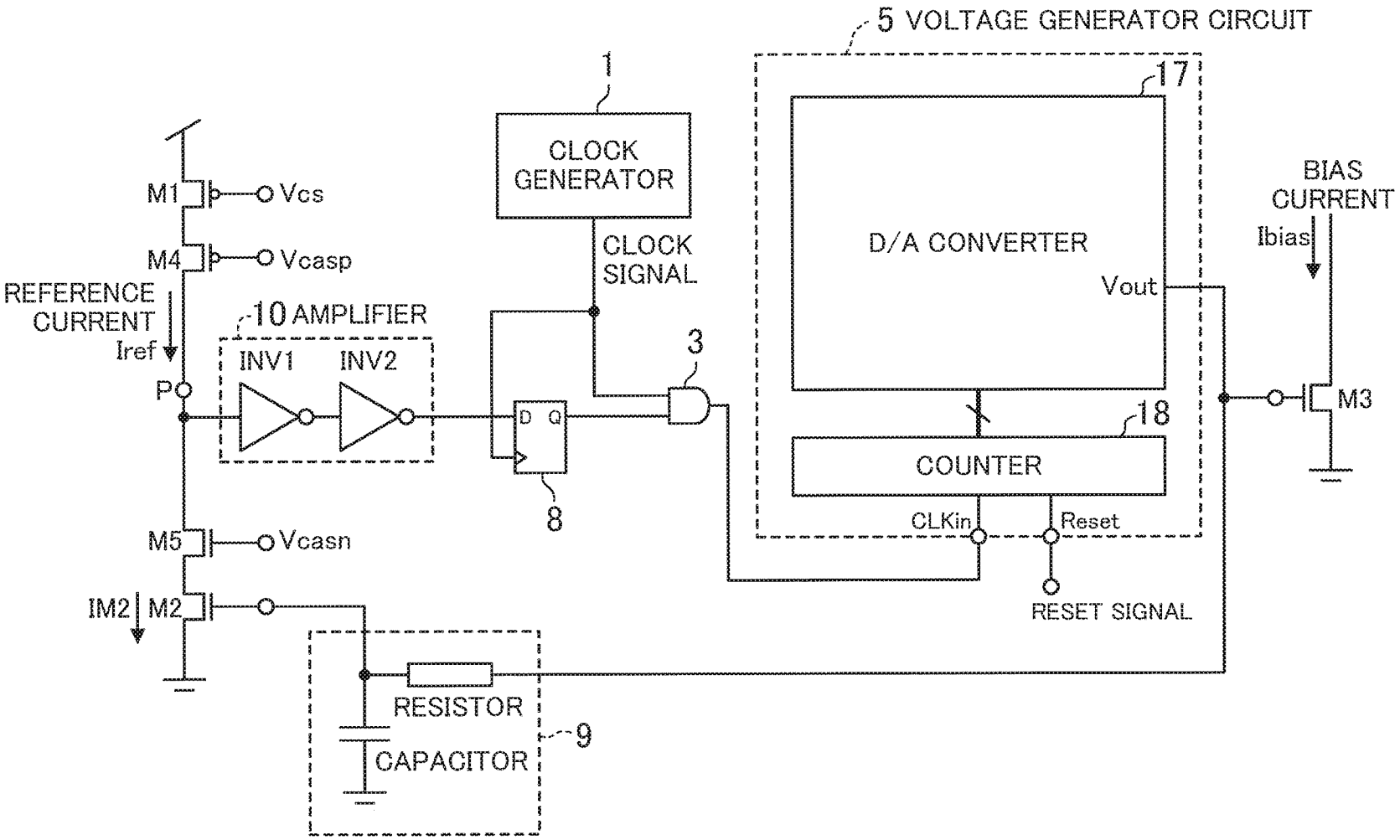
FIG. 11 is a circuit diagram illustrating a configuration for a bias generator circuit according to a fourth embodiment.

FIG. 11 is a circuit diagram illustrating a configuration for a bias generator circuit according to a fourth embodiment. In FIG. 11, any component having substantially the same function as its counterpart shown in FIG. 8 or 9 is identified by the same reference numeral as the counterpart's. The configuration and operation of this embodiment are basically the same as what has already been described for the third embodiment. Thus, the following description of the fourth embodiment will be focused on differences from the third embodiment.

The voltage generator circuit 5 shown in FIG. 11 has substantially the same configuration as the voltage generator circuit 5 shown in FIG. 8. The voltage generator circuit 5 includes a digital-to-analog (D/A) converter 17 for converting a digital signal into an analog signal and a counter 18 for counting the number of clock cycles of the clock signal CLKin. Output data of the counter 18 is supplied to the D/A converter 17, the output of which is delivered as an output voltage Vout. This configuration easily allows the voltage generator circuit 5 to increase or decrease the output voltage Vout of the D/A converter 17 on a grayscale level basis in accordance with the number of clock cycles, with its area reduced.

In addition, according to the configuration shown in FIG. 11, a flip-flop 8 is also arranged as in the configuration shown in FIG. 8 on the control signal input end of the clock gating circuit 3. This reduces the likelihood of the voltage generator circuit's 5 malfunctioning due to a glitch of the output voltage Vout. Also, according to the configuration shown in FIG. 11, a low-pass filter 9 is provided on a path for transmitting the output voltage Vout of the voltage generator circuit 5 to the gate of the second transistor M2. This low-pass filter 9 contributes to reducing the glitch itself.

Moreover, in the configuration shown in FIG. 11, a PMOS cascode transistor M4 is further arranged on the drain end of the first transistor M1 implemented as a PMOS for generating the reference current Iref. In addition, an NMOS cascode transistor M5 is further arranged on the drain end of the second transistor M2 implemented as an NMOS. As a result, the node P receiving the reference current Iref comes to have a higher impedance. This allows the voltage at the node P to fall more steeply from High level to Low level (or rise more steeply from Low level to High level), thus enabling setting the bias current with higher precision. Although the NMOS cascode transistor M4 and the PMOS cascode transistor M5 are both provided in the configuration shown in FIG. 11, one of them may be omitted as well.

In addition, in the configuration shown in FIG. 11, an amplifier 10 is provided between the node P and one input terminal of the AND gate 3. This amplifier 10 amplifies the variation in voltage at the node P to allow the voltage to vary more steeply. This makes for a more precise bias current setting. In this example, the amplifier 10 is comprised of two-stage inverters INV1 and INV2. However, this is only a non-limiting example. Alternatively, a comparator receiving a predetermined voltage at one of two input terminals thereof may be used instead.

As can be seen from the foregoing description, this embodiment, as well as the third embodiment described above, requires no digital controller to perform a predetermined procedure of control in determining a bias current, and allows a desired bias current to be generated automatically just by applying a clock signal to a sufficiently simple configuration. In addition, the voltage generator circuit 5 is comprised of the D/A converter 17 and the counter 18, and therefore, may have a much smaller circuit size than the third embodiment. Furthermore, this may also significantly reduce the likelihood of the voltage generator circuit's 5 malfunctioning due to a glitch of its output voltage Vout.

Optionally, the flip-flop 8 and low-pass filter 9 of this embodiment may be added to the configuration of the third embodiment shown in FIG. 9. This may reduce the likelihood of the voltage generator circuit's 4 malfunctioning due to a glitch of its output voltage Vout as significantly as in this embodiment. Additionally, the cascode transistors M4, M5 and amplifier 10 of this embodiment may also be added to the configuration of the third embodiment shown in FIG. 9. This allows the control signal input to the clock gating circuit to vary as steeply as in this embodiment, thus making for a more precise bias current setting.

In the embodiments described above, the clock gating circuit is supposed to be implemented as an AND gate. However, this is only an example. Alternatively, the clock gating circuit may also be implemented as an OR gate or a switched inverter circuit as well.

The bias generator circuit described for the foregoing embodiments is applicable to communications devices and radar devices, to name just a few. A communications device or radar device may be configured to have either its bias voltage or bias current set by a bias generator circuit according to any of the embodiments described above either when booted or at regular intervals.

The present disclosure provides a bias generator circuit having the ability to set a desired bias voltage or bias current easily using a simple configuration, thus contributing effectively to slashing costs and economizing the power consumption of, for example, communications devices, radar devices, and various other types of devices that need a low-noise bias generator circuit.

What is claimed is:

1. A bias generator circuit comprising:

a voltage generator circuit for increasing or decreasing an output voltage thereof in accordance with a number of clock cycles of a given clock signal;

a comparator for comparing the output voltage of the voltage generator circuit to a reference voltage;

a clock generator for generating the clock signal; and a clock gating circuit for receiving, as a control signal, output of the comparator and controlling, in accordance with the control signal, whether or not to pass the clock signal supplied from the clock generator to the voltage generator circuit, wherein the output voltage of the voltage generator circuit is output as a bias voltage, and the voltage generator circuit comprises:

an output terminal for outputting the output voltage;

a resistor bank in which a plurality of resistors are connected together in series and to which a predetermined voltage is applied between both ends thereof;

a plurality of switches, each of which is selectively turned ON or OFF and has one of two terminals thereof connected to an associated resistor node in the resistor bank and another of the two terminals thereof connected to the output terminal; and a switch selector section for receiving the clock signal and selectively turning ON any one of the plurality of switches according to the number of clock cycles of the clock signal.

2. The bias generator circuit of claim 1, wherein the switch selector section comprises:

a first selector for receiving the clock signal, outputting a plurality of first switch select signals, any one of the plurality of first switch select signals having a predetermined first logical value, and shifting the plurality of first switch select signals on either a rising edge or a falling edge of the clock signal;

a second selector for receiving one of the plurality of first switch select signals, outputting a plurality of second switch select signals, any one of the plurality of second select signals having a predetermined second logical value, and shifting the plurality of second switch select signals on either a rising edge or a falling edge of the one of the plurality of first switch select signals; and a plurality of logic circuits, each of which is provided for an associated one of the plurality of switches, receives any one of the plurality of first switch select signals and any one of the plurality of second switch select signals, and outputs a signal to control ON/OFF states of the associated switch.

3. The bias generator circuit of claim 1, wherein the switch selector section comprises either a shift register or a counter.

4. The bias generator circuit of claim 1, wherein the voltage generator circuit generally increases its output voltage as the number of clock cycles increases, and the output voltage temporarily decreases as the number of clock cycles increases, or the voltage generator circuit generally decreases its output voltage as the number of clock cycles increases, and the output voltage temporarily increases as the number of clock cycles increases.

5. The bias generator circuit of claim 1, wherein the voltage generator circuit comprises:

a digital-to-analog converter for converting a digital signal into an analog signal; and a counter for counting the number of clock cycles of the clock signal, wherein output of the counter is supplied to the digital-to-analog converter, and output of the digital-to-analog converter is delivered as the output voltage.

6. The bias generator circuit of claim 5, wherein the digital-to-analog converter is an R-2R digital-to-analog converter.

7. The bias generator circuit of claim 1, wherein the clock gating circuit is configured as an AND gate, an OR gate, or a switched inverter circuit.

8. The bias generator circuit of claim 1, wherein a flip-flop is arranged on a control signal input end of the clock gating circuit.

9. The bias generator circuit of claim 1, wherein a low-pass filter is provided on a path through which the output voltage of the voltage generator circuit is transmitted to an input terminal of the comparator.

10. The bias generator circuit of claim 1, wherein the voltage generator circuit comprises a reset signal terminal to which a reset signal for setting an initial value of the output voltage is applied.

11. A communications device comprising the bias generator circuit of claim 1, wherein the bias voltage is set by the bias generator circuit either when the device is booted or at regular intervals.

12. A radar device comprising the bias generator circuit of claim 1, wherein the bias voltage is set by the bias generator circuit either when the device is booted or at regular intervals.

13. A bias generator circuit comprising:

a voltage generator circuit for increasing or decreasing an output voltage thereof in accordance with a number of clock cycles of a given clock signal;

a first transistor for generating a reference current;

a second transistor for receiving the output voltage of the voltage generator circuit at the second transistor's gate and the reference current at the second transistor's drain;

a clock generator for generating the clock signal;

a clock gating circuit for receiving, as a control signal, a drain voltage of the second transistor and controlling, in accordance with the control signal, whether or not to pass the clock signal supplied from the clock generator to the voltage generator circuit; and a third transistor for receiving the output voltage of the voltage generator circuit at the third transistor's gate and outputting a bias current from the third transistor's drain.

14. The bias generator circuit of claim 13, wherein a cascode transistor is provided for either the first transistor's drain or the second transistor's drain.

15. The bias generator circuit of claim 13, wherein an amplifier is arranged between the drain of the second transistor and an input terminal of the clock gating circuit.

16. The bias generator circuit of claim 13, wherein the voltage generator circuit comprises:

an output terminal for outputting the output voltage;

a resistor bank in which a plurality of resistors are connected together in series and to which a predetermined voltage is applied between both ends thereof;

a plurality of switches, each of which is selectively turned ON or OFF and has one of two terminals thereof connected to an associated resistor node in the resistor bank and another of the two terminals thereof connected to the output terminal; and a switch selector section for receiving the clock signal and selectively turning ON any one of the plurality of switches according to the number of clock cycles of the clock signal.

17. The bias generator circuit of claim 16, wherein the switch selector section comprises:

a first selector for receiving the clock signal, outputting a plurality of first switch select signals, any one of the plurality of first switch select signals having a predetermined first logical value, and shifting the plurality of first switch select signals on either a rising edge or a falling edge of the clock signal;

a second selector for receiving one of the plurality of first switch select signals, outputting a plurality of second switch select signals, any one of the plurality of second switch select signals having a predetermined second logical value, and shifting the plurality of second switch select signals on either a rising edge or a falling edge of the one of the plurality of first switch select signals; and a plurality of logic circuits, each of which is provided for an associated one of the plurality of switches, receives any one of the plurality of first switch select signals and any one of the plurality of second switch select signals, and outputs a signal to control ON/OFF states of the associated switch.

18. The bias generator circuit of claim 16, wherein the switch selector section comprises either a shift register or a counter.

19. The bias generator circuit of claim 13, wherein the voltage generator circuit generally increases its output voltage as the number of clock cycles increases, and the output voltage temporarily decreases as the number of clock cycles increases, or the voltage generator circuit generally decreases its output voltage as the number of clock cycles increases, and the output voltage temporarily increases as the number of clock cycles increases.

20. The bias generator circuit of claim 13, wherein the voltage generator circuit comprises:

a digital-to-analog converter for converting a digital signal into an analog signal; and a counter for counting the number of clock cycles of the clock signal, wherein output of the counter is supplied to the digital-to-analog converter, and output of the digital-to-analog converter is delivered as the output voltage.

21. The bias generator circuit of claim 20, wherein the digital-to-analog converter is an R-2R digital-to-analog converter.

22. The bias generator circuit of claim 13, wherein the clock gating circuit is configured as an AND gate, an OR gate, or a switched inverter circuit.

23. The bias generator circuit of claim 13, wherein a flip-flop is arranged on a control signal input end of the clock gating circuit.

24. The bias generator circuit of claim 13, wherein a low-pass filter is provided on a path through which the output voltage of the voltage generator circuit is transmitted to the gate of the second transistor.

25. The bias generator circuit of claim 13, wherein the voltage generator circuit comprises a reset signal terminal to which a reset signal for setting an initial value of the output voltage is applied.

26. A communications device comprising the bias generator circuit of claim 13, wherein the bias current is set by the bias generator circuit either when the device is booted or at regular intervals.

27. A radar device comprising the bias generator circuit of claim 13, wherein the bias current is set by the bias generator circuit either when the device is booted or at regular intervals.

28. A voltage generator circuit for increasing or decreasing an output voltage thereof in accordance with a number of clock cycles of a given clock signal, the voltage generator circuit comprising:

an output terminal for outputting the output voltage;

a first resistor bank in which a plurality of resistors are connected together in series;

a first group of switches, each of the switches being selectively turned ON or OFF and having one of two terminals thereof connected to an associated resistor node in the first resistor bank and another of the two terminals thereof connected to the output terminal;

a first switch selector for receiving the clock signal and selectively turning ON any one of the switches in the first group of switches according to the number of clock cycles of the clock signal;

a second resistor bank in which a plurality of resistors are connected together in series and which receives a predetermined voltage applied between both ends thereof;

a second group of switches, each of the switches being selectively turned ON or OFF and having one of two terminals thereof connected to an associated resistor node in the second resistor bank and another of the two terminals thereof connected to one end of the first resistor bank;

a third group of switches, each of the switches being selectively turned ON or OFF and having one of two terminals thereof connected to an associated resistor node in the second resistor bank and another of the two terminals thereof connected to another end of the first resistor bank; and a second switch selector for receiving any one of output signals of the first switch selector and selectively turning ON, in response to the output signal, any one of the switches in the second group of switches and any one of the switches in the third group of switches.

29. The voltage generator circuit of claim 28, wherein the first and second switch selectors each comprise a shift register or a counter.

30. A voltage generator circuit for increasing or decreasing an output voltage thereof in accordance with a number of clock cycles of a given clock signal, the voltage generator circuit comprising:

an output terminal for outputting the output voltage;

a first resistor bank in which a plurality of resistors are connected together in series;

a first group of switches, each of the switches being selectively turned ON or OFF and having one of two terminals thereof connected to an associated resistor node in the first resistor bank and another of the two terminals thereof connected to the output terminal;

a first switch selector for receiving the clock signal and selectively turning ON any one of the switches in the first group of switches according to the number of clock cycles of the clock signal;

a second resistor bank in which a plurality of resistors are connected together in series and which has one end thereof connected to one end of the first resistor bank;

a third resistor bank in which a plurality of resistors are connected together in series and which has one end thereof connected to another end of the first resistor bank;

a second group of switches, each of the switches being selectively turned ON or OFF and having one of two terminals thereof connected to an associated resistor node in the second resistor bank and another of the two terminals thereof connected to a low-potential supply terminal;

a third group of switches, each of the switches being selectively turned ON or OFF and having one of two terminals thereof connected to an associated resistor node in the third resistor bank and another of the two terminals thereof connected to a high-potential supply terminal; and a second switch selector for receiving any one of output signals of the first switch selector and selectively turning ON, in response to the output signal, any one of the switches in the second group of switches and any one of the switches in the third group of switches.

31. The voltage generator circuit of claim 30, wherein the first and second switch selectors each comprise a shift register or a counter.

* * * * *